US007467721B2

(12) United States Patent
Choi

(10) Patent No.: US 7,467,721 B2
(45) Date of Patent: Dec. 23, 2008

(54) COMBINED COMPONENTS ASSEMBLY OF A COMBINED RACK

(76) Inventor: Ying-Kit Choi, 7F1-6, No. 303 Tun Hwa North Road, Taipei (TW)

( * ) Notice: Subject to any disclaimer, the term of this patent is extended or adjusted under 35 U.S.C. 154(b) by 603 days.

(21) Appl. No.: 11/291,669

(22) Filed: Dec. 1, 2005

(65) Prior Publication Data

US 2007/0125735 A1 Jun. 7, 2007

(51) Int. Cl.
*A47B 43/00* (2006.01)

(52) U.S. Cl. ..... 211/189

(58) Field of Classification Search ..... 211/189, 211/187, 186, 188, 194, 195, 182, 183; 108/107, 108/108, 153
See application file for complete search history.

(56) References Cited

U.S. PATENT DOCUMENTS 3,871,726 A * 3/1975 Stegner ..... 312/195
3,874,753 A * 4/1975 Naito et al. ..... 312/111
3,961,586 A * 6/1976 Bernard ..... 108/60
4,223,966 A * 9/1980 Winters ..... 312/140
4,403,554 A * 9/1983 Valentine et al. ..... 108/23
4,540,222 A * 9/1985 Burrell ..... 312/257.1
4,843,977 A * 7/1989 Bridges ..... 108/152
5,002,248 A * 3/1991 Knape et al. ..... 248/243
5,349,909 A * 9/1994 Smit et al. ..... 108/107
5,478,145 A * 12/1995 Kamachi ..... 312/263
5,582,306 A * 12/1996 Balter et al. ..... 211/187
5,725,096 A * 3/1998 Winnard ..... 206/350
5,762,213 A * 6/1998 Heneveld, Sr. ..... 211/187
5,833,084 A * 11/1998 Chang ..... 211/187
5,842,586 A * 12/1998 Melby ..... 211/187
5,850,784 A * 12/1998 Conner ..... 99/485
6,378,712 B1 * 4/2002 Sampl ..... 211/186
6,634,511 B2 * 10/2003 Manghera ..... 211/187
6,648,155 B1 * 11/2003 Wang ..... 211/187
RE38,707 E * 3/2005 Merkel ..... 211/135
6,918,497 B2 * 7/2005 Davis ..... 211/183
7,165,690 B2 * 1/2007 Wu ..... 211/192
7,293,667 B2 * 11/2007 Flynn ..... 211/189
7,350,649 B1 * 4/2008 Martens ..... 211/90.02
2002/0162814 A1 * 11/2002 Gawel ..... 211/183
2003/0116517 A1 * 6/2003 Manghera ..... 211/187
2004/0035810 A1 * 2/2004 Eustace ..... 211/162
2006/0070967 A1 * 4/2006 Schaubeck et al. ..... 211/187

(Continued)

FOREIGN PATENT DOCUMENTS

TW 248316 11/2004

(Continued)

*Primary Examiner*—Sarah Purol
(74) *Attorney, Agent, or Firm*—Shoemaker and Mattare

(57) ABSTRACT

A combined components assembly of a combined rack is provided, which at least includes a lateral rack board, an erect rack board, an expansion material, an intensified rack board and a serial joint material. The lateral rack board and the erect rack board can form a frame unit and can be serial fixed by the serial joint material; and the expansion material can stride over the erect rack board and correspond to the lateral rack board to connect other frame units or bond the intensified rack board, such that elastic expansion and variation functions of the combined rack are provided. Furthermore, structural strength of the combined rack can be enhanced by the serial fixation of the serial joint material and the bond of the intensified rack board.

24 Claims, 34 Drawing Sheets

U.S. PATENT DOCUMENTS

2006/0118503 A1* 6/2006 Patton ..... 211/187
2006/0186072 A1* 8/2006 Naruishi et al. ..... 211/189
2007/0125735 A1* 6/2007 Choi ..... 211/186
2007/0125738 A1* 6/2007 Sevack ..... 211/187
2007/0278170 A1* 12/2007 Wiebe ..... 211/187

FOREIGN PATENT DOCUMENTS

TW 254145 1/2005

* cited by examiner

COMBINED COMPONENTS ASSEMBLY OF A COMBINED RACK

FIELD OF THE INVENTION

The present invention relates to component designs of combined racks and, more particularly, to a combined components assembly of a combined rack.

BACKGROUND OF THE INVENTION

FIG. 1 shows a combined rack 1 used for object placement or exhibition at present. A plurality of lateral rack boards 11 and erect rack boards 13 are constructed to a frame unit or a plurality of frame units, and a plurality of bolts 131 are through the surface of the erect rack boards 13 and screw two sides of the corresponding lateral rack boards 11 to fix the lateral rack boards 11 and erect rack boards 13. A plurality of arrayed jacks 133 are set inside the face of the erect rack boards 13 for plugging snugs 135, and the snugs 135 are arranged symmetrically to form a bearing surface for clap boards 15 such as glass boards, wood boards and the like striding there over. Furthermore, fixed links 17 are further set across the backside of the combined rack 1 to increase intensity and avoid distortion, such that at least one diagonal length of the frame unit is limited.

The bolts 131 are mainly used to combine and fix the lateral rack boards 11 and the erect rack boards 13 in the above combined rack 1, i.e. the bolts 131 are used to bear all weights of the lateral rack boards 11 and the clap boards 15, so it may cause distortion and looseness of the bolts 131 or screwing portions. Moreover, it may wear and tear the screwing portions if the combined rack 1 is repeatedly assembled or disassembled; thereby it causes low stability of the screwing portions.

Additionally, the lateral rack boards 11 and the erect rack boards 13 of the above combined rack 1 are normalized products with specified width extruded by aluminum, plastic, however other lateral rack boards 11 and erect rack boards 13 with new specification must be selected if outward appearance of the combined rack 1 is needed to be regulated, thereby it causes a large waste of resource which violates environmental protection. Moreover, the beauty of the combined rack 1 may also be affected by using the fixed links 17.

Therefore, an improved combined rack structure is proposed in TW Patent No. M248316. The combined rack is combined with symmetrical brackets and pipe brackets, wherein a plurality of screw thread sticks are set inside upper, lower lateral pipe of the pipe brackets, a plurality of linings are set in gaps between two sides of the screw thread sticks and upper, lower lateral pipes, and the screw thread can pass through and fix the brackets in conjunction with special screw caps. This patent may increase intensity and beauty of the combined rack, but it still can not solve reusability of combined components according to width expansion mentioned above.

Additionally, an elastic combined rack structure is proposed in TW Patent No. M254145. The combined rack is combined with a plurality of pipe connections and pipes. The pipe connection includes a ball, a joint sleeve, a plug, a gasket and a bolt, wherein a screw is set at one side of the ball for connecting the joint sleeve; a sleeve hole is set in center of the joint sleeve for inserting the plug which is proportional to the joint sleeve; a through hole is set in center of the plug; and a hole site is set at one side of the pipe for spanner to regulate the bolt which fixes the joint sleeve into the pipe. The combined rack of this patent may provide a plurality of expansion directions by the pipe connections, but other pipe connections must be selected according to expansion demands of the combined rack, thus the problem in reusability of combined components still can not be solved. Furthermore, stable combining intensity can not be provided by use of the ball and the pipe, accordingly the combined rack of this patent is only adapted in slight loads such as an exhibition rack for clothes, whereas it still can not be used in loading general or heavy objects, such as electronic household appliance.

As a result, the present subject to be solved is to provide a combined components assembly of a combined rack which can overcome problems of the prior art, such as difficulty in expansion, low structural intensity, limitation in loads and combination, unreusability of combined components, appearance without integration and the like.

SUMMARY OF THE INVENTION

To overcome the above-mentioned problems, it is a primary objective of the present invention to provide a combined components assembly of a combined rack for providing elastic expansion functions of the combined rack.

It is another objective of the present invention to provide a combined components assembly of a combined rack for increasing structural strength of the combined rack.

It is a further objective of the present invention to provide a combined components assembly of a combined rack for accommodating various loads.

It is still another objective of the present invention to provide a combined components assembly of a combined rack for adding variations of the combined rack.

It is yet another objective of the present invention to provide a combined components assembly of a combined rack for repeatedly using the same combined components to form a combined rack with integrated appearance in accordance with environmental protection.

To achieve the above-mentioned and other objectives, a combined components assembly of a combined rack is provided according to the present invention, which at least comprises: a lateral rack board having a first through hole; an erect rack board for forming a frame unit with the lateral rack board, wherein the erect rack board has a second through hole; an expansion material for striding over the erect rack board and corresponding to the lateral rack board, wherein the expansion material has at least a third through hole and two first bonding portions for striding to two sides of the erect rack board; an intensified rack board setting between a plurality of expansion materials of a frame unit, wherein the intensified rack board has two second bonding portions for respectively bonding to the first bonding portions; and a serial joint material for penetrating through the first through hole, the second through hole and the third through hole in order to serially fix the lateral rack board, the erect rack board and the expansion material.

The above-mentioned expansion material may have two first bonding portions and one or more third through holes spatially arranged between the two first bonding portions. Preferably, the first bonding portion is a big screw and the second bonding portion is a small screw for a bolt passing through the big screw and bonding to the small screw; or the first bonding portion is a big screw and the second bonding portion is a small screw for bonding a bolt which has a rotation axis on a bottom of the bolt to the big screw and axially connecting to the small screw by the rotation axis. A bottom side of the expansion material has a groove for striding over the erect rack board, and at least one end of the groove is bond to a stop board if the intensified rack board is rotatively bonded to the first bonding portion by the second bonding portion of the same side. Each of two sides of the intensified rack board is bonded to a frame and the first bonding portions are formed on upper and lower end of the frame.

Two third bonding portions are set on two sides of the serial joint material for respectively connecting a bonding component, wherein the third bonding portion is a screw and the bonding component is a bolt. The head of the bonding component has an outer thread for screwing a capping sheet having an inner thread, furthermore a bottom segment of the serial joint material has an outer thread for screwing a foot rest having an inner thread.

A first fixed portion is set on at least one side of the erect rack board corresponding to the second through hole, and a second fixed portion opposed to the first fixed portion is set on an outside of the serial joint material. Preferably, the first fixed portion is a rib and the second fixed portion is a groove. The erect rack board may have a plurality of first locked portions, and preferably a plurality of first locked portions may be set on each side or one side of the erect rack board. One side of the erect rack board can be connected with a side line and the first locked portion is formed on a surface of the side line. Moreover, the erect rack board further includes a jack for plugging a non-slip mat.

The lateral rack board may also have a plurality of first locked portions, and preferably a plurality of first locked portions may be set on each side or one side of the lateral rack board. Moreover, one side of the lateral rack board also can be connected with a side line and the first locked portion is formed on a surface of the side line. The lateral rack board has at least a recess which is opened towards a bottom for holding a lamp, and a slot is set at a bottom edge of the recess for plugging a transparent window board. An outer frame board having a fourth through hole for penetrating the serial joint material is bonded to an outside of the lateral rack board and two side closing boards are respectively bonded to two sides of the outer frame board, wherein screws are set on two sides of the lateral rack board for bonding to the side closing boards with bolts, and two lugs are set on the two sides of the lateral rack board for bonding the lateral rack board to a bottom side of the outer frame board.

The combined components assembly of a combined rack further comprises a spacer for setting on a joint face between the erect rack board and the lateral rack board; or further comprises a fastened seat for bonding to a top face of the erect rack board and a fastened mat for bonding to a bottom face of the lateral rack board, wherein the fastened seat has a groove and the fastened mat has a barb for fastening to each other; or further comprises a clap board rack having at least a raised line on an outside thereof, a stridden slot for striding over a top or a bottom end of the erect rack board, and two raised lines symmetrical to the clap board rack for striding over the clap board rack.

Furthermore, the combined components assembly of a combined rack may comprises a butt joint material with two second locked portions respectively on two sides of the butt joint material for locking to the first locked portions. The butt joint material has a channel for spacing the two second locked portions, and each of the two second locked portions has at least a screw through the channel for screwing a pressure component, wherein the pressure component is a dual head fixed screw with a groove and an angle post on two sides of the dual head fixed screw. Preferably, the groove can be a one-shaped groove or a cross-shaped groove; and the angle post may be a quadrangle or a hexagon angle post.

Moreover, a ribbon having a second locked portion; a hook material having a second locked portion; a hinge material having a second locked portion; a bearing material having a second locked portion; a back rack board having two second locked portions for locking to the first locked portions of the two erect rack boards; or a slide-rail material for hanging a slide door having a pulley block, wherein the slide-rail has a second locked portion for locking to the first locked portion may be further included. The bearing material further includes a projecting pallet and a through screw is set on a surface of the pallet.

Furthermore, a rotated locked tool for locking the pressure component is further included, wherein the rotated locked tool includes a metal sheet with at least a one-shaped rotated locked end, an outside-angle rotated locked end, an inside-angle rotated locked end and a rod rotated end formed thereon.

The first locked portion is a slot and the second locked portion is a block, and preferably, the slot is a dovetail slot and the block is a dovetail block. Meanwhile, the first locked portion and the second locked portion are designed in same specification and can be transformed or combined at random.

DETAILED DESCRIPTION OF THE PREFERRED EMBODIMENTS

Figure 1:
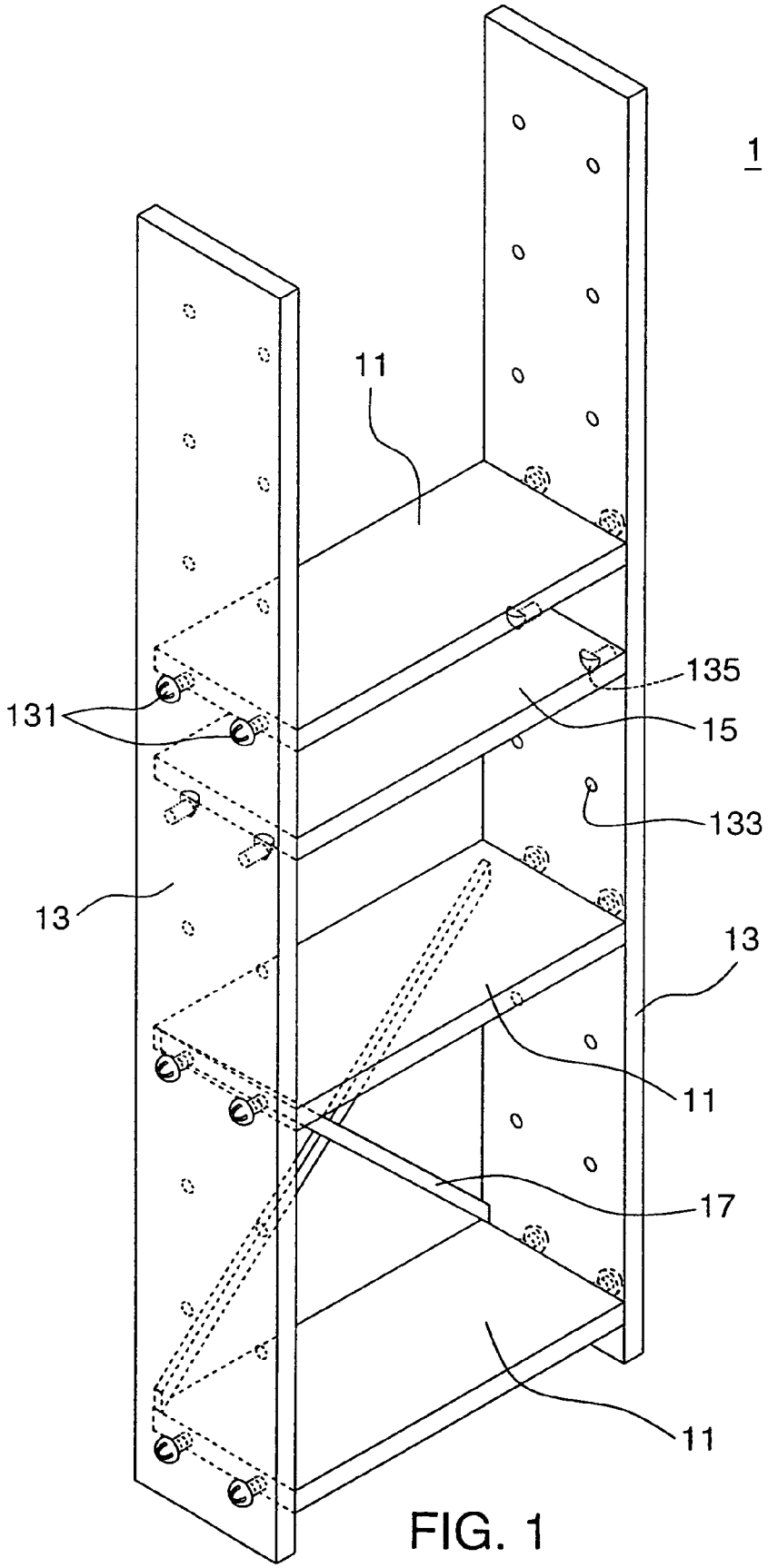
FIG. 1 is a cross-sectional view showing a structure of a combined rack of a prior art.

The following special embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention. Furthermore, it should be noted that the appending drawings are made in simplicity only to easily illustrate the basic structure of the present invention. Accordingly, only associated components of the present invention are shown in the drawings and these components are not drawn in actual numbers, shapes and dimensions, thereby the sizes of the components in practical implements may be an alternative design and the layout of the components may be more complicated.

Figure 2A:
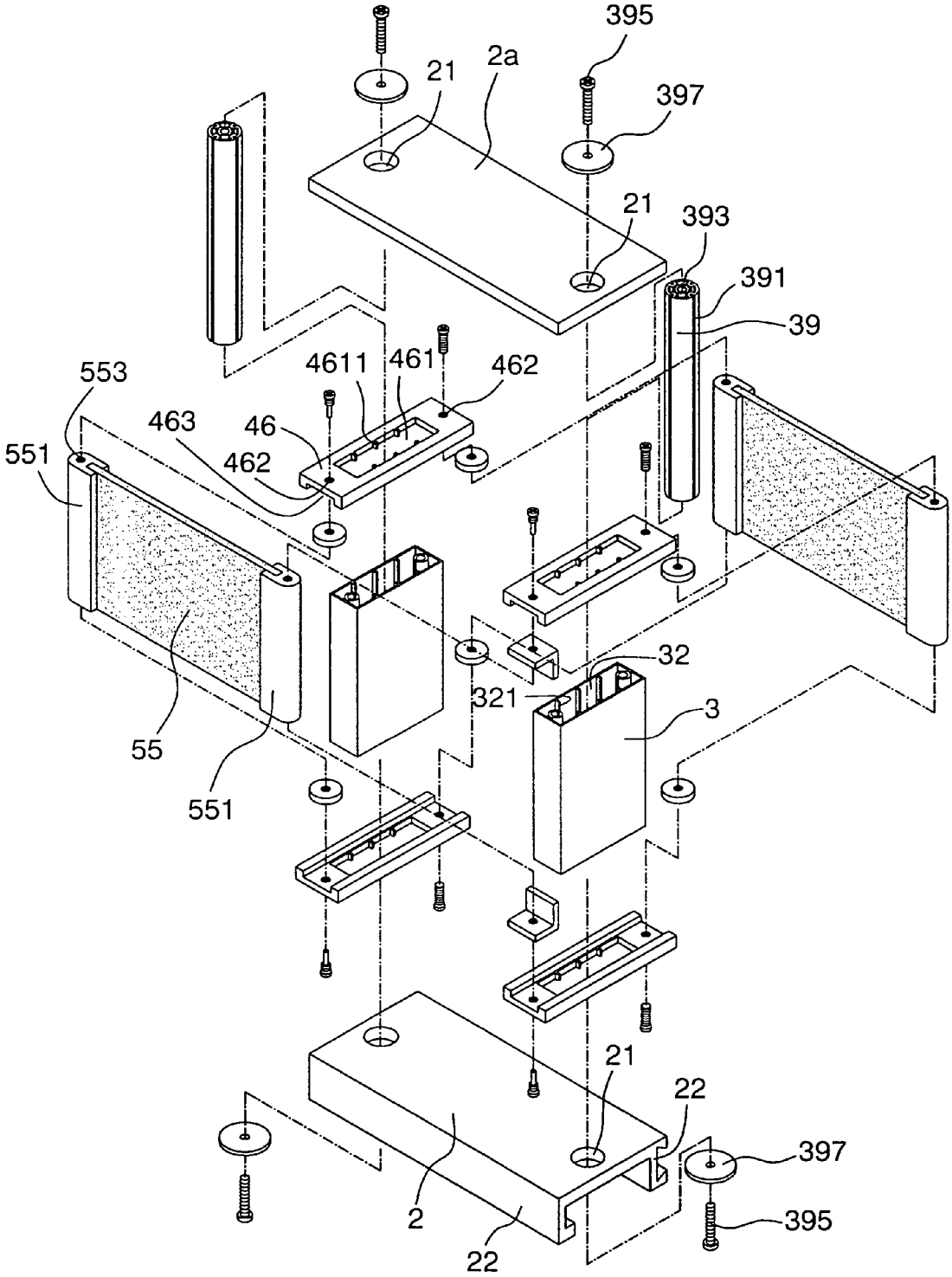
FIG. 2A is a cross-sectional view showing combined components of a combined rack according to the present invention.

Referring to FIG. 2A, it shows combined components of a combined rack according to the present invention. The combined components assembly at least comprises a lateral rack board 2(2*a*), an erect rack board 3, an expansion material 46, an intensified rack board 55 and a serial joint material 39. Symmetrical lateral rack boards 2 and erect rack boards 3 can be combined to a frame unit or a plurality of frame units, the serial joint material 39 is used to serially fix the lateral rack board 2 and the erect rack board 3, and the expansion material 46 is set between upper and lower sides of the erect rack board 3 opposed to the lateral rack board 2 for bonding the intensified rack board 55 on a backside thereof or providing elastic expansion function of the combined rack.

The lateral rack board has a first through hole; the erect rack board for forming a frame unit with the lateral rack board has a second through hole; the expansion material for striding over the erect rack board and corresponding to the lateral rack board has at least a third through hole and two first bonding portions for striding to two sides of the erect rack board; the intensified rack board setting between a plurality of expansion material of a frame unit has two second bonding portions for respectively bonding to the first bonding portions; and the serial joint material for penetrating through the first through hole, the second through hole and the third through hole in order to serially fix the lateral rack board, the erect rack board and the expansion material.

Figure 2B:
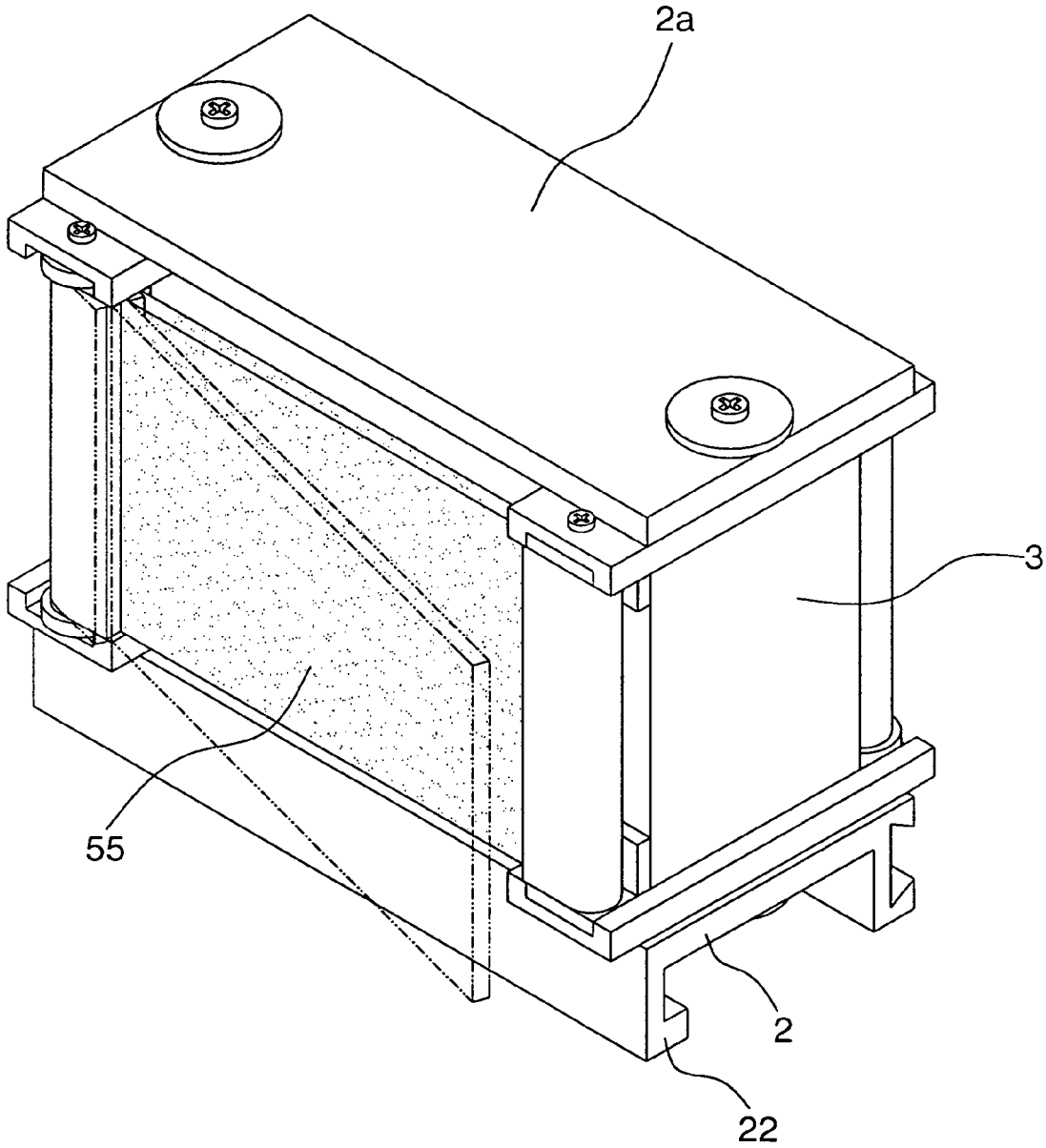
FIG. 2B is a cross-sectional showing a first embodiment using the combined rack of the present invention.

Referring to FIG. 2A and FIG. 2B, a combined rack as shown in FIG. 2B is combined with the above combined components. In detail, the combined rack is consisted of two lateral rack boards 2, two erect rack boards 3, two serial joint materials 39, four expansion materials 46 and two intensified rack boards 55.

The lateral rack board 2 is extruded by metal, plastic or the like and it may be a plate structure or a hollow frame structure; two first through holes 21 for penetrating the serial joint materials are on a face of the lateral rack board 2, for example, they may be set near two sides of the face; and projecting mats 22 are set on front and back sides of a bottom face of the lateral rack board. Furthermore, the lateral rack board 2 can be used as a bottom board, an interlayer board or a top board, or it can be simplified to a lateral rack board 2*a* by omitting the mats 22. Additionally, the lateral rack board 2 can also be a plate made of glass, stone, cement, wood and the like.

The erect rack board 3 is a hollow frame extruded by metal, plastic or the like and has a second through hole 32 for penetrating the serial joint material 39, wherein two first fixed portions 321 such as ribs are set on two sides corresponding to the second through hole 32.

The expansion material 46 is extruded by metal, plastic or the like and a recess 463 for striding over the erect rack board and corresponding to the lateral rack board is set on a bottom of the expansion material, wherein the width of the recess is equal to that of the erect rack board 3. At least a third through hole 461 for penetrating the serial joint material 39 is set on a face of the expansion material 46, and two third fixed portions 4611 such as ribs are set on two sides corresponding to the third through hole 461, wherein the structure of the third fixed portions 4611 is the same as that of the first fixed portion 321. Additionally, two first bonding portions 462 such as screws are set near two sides of the expansion material 46 for respectively striding to two sides of the erect rack board 3.

The serial joint material 39 is extruded by metal, plastic or the like, a second fixed portion 391 opposed to the first fixed portion 321 is set on an outside of the serial joint material 39 and two third bonding portions 393 such as screws are set on two sides of the serial joint material 39. In the present embodiment, the serial joint material 39 is a columnar with four equally spaced second fixed portions 391 set thereon. The second fixed portion 391 of the serial joint material 39 penetrates through the erect rack board 3, the first fixed portion 321 of the second through hole 32, the third fixed portion 4611 of the expansion material 46, and the first through hole 21 of the lateral rack board 2(2*a*); and then screws to the third bonding portion 393 by bonding component 395 such as a bolt in conjunction with a gasket 397 so as to tightly bond and fix the lateral rack board 2, the erect rack board 3 and the expansion material 46.

The intensified rack board 55 is set between four expansion materials 46 which are used to form a frame unit, and has second bonding portions 553 for bonding to the first bonding portions 462. In this embodiment, each of two sides of the intensified rack board 55 is bonded to a frame 551 and the second bonding portions 553 are formed on a upper and a lower end of the frame. Meanwhile, the intensified rack board can be mounted not only in a backside of the combined rack, but also in a front side to form an active door.

The two lateral rack boards 2(2*a*) and the two erect rack boards 3 are serially fixed by the serial joint materials 39 in the present embodiment, so the total weight of the combined rack is evenly distributed on the lateral rack boards 2(2*a*), the erect rack boards 3 and the serial joint materials 39. Furthermore, the vertical relationship between the lateral rack board 2(2*a*) and the erect rack board 3 is decided by the serial joint material 39 and the first through hole 21, i.e. the bonding components 395 such as bolts for locating limitation are not needed to provide functions of bearing the total weight of the combined rack and bending torque which may cause distortion. Accordingly, the bonding intensity of the combined rack is perfect and there may be no looseness between the bonding components 395 and the third bonding portions 393 of the serial joint material 39.

Moreover, to increase the structural intensity and stability of the combined rack for heavy loads, at least one intensified rack board 55 is bonded to the back or front side of the two erect rack boards by the expansion material 46, and parallelism of the two erect rack boards 3 or verticality opposed to the two lateral rack boards of the two erect rack boards 3 can be ensured stably by use of the connection between the second bonding portion 553 and the first bonding portion 462.

The first bonding portions 462 mentioned above are used to assemble the intensified rack board 55 to form as a back board or an active door of the combined rack.

Figure 3A:
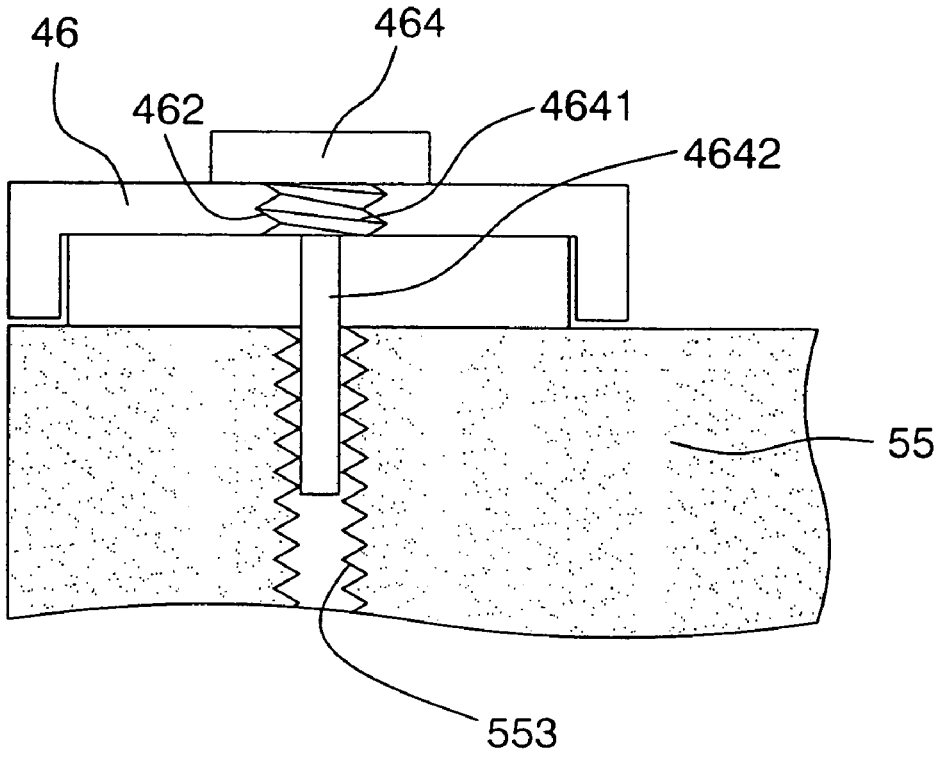
FIG. 3A and FIG. 3B are cross-sectional views showing two combined structures of an expansion material and an intensified rack board according to the present invention.

As shown in FIG. 3A, when the intensified rack board 55 is formed as an active door, the first bonding portion 462 of the expansion material 46 is a big screw and the second bonding portion 553 of the intensified rack board 55 is a small screw for bonding a bolt 464 which has a rotation axis 4642 on a bottom of the bolt 464. The bolt 464 screws the first bonding portion 462 by its outer thread 4641 and the rotation axis 4642 is axially connects to the second bonding portion 553, wherein the outside diameter of the rotation axis 4642 is matched to the second bonding portion. Meanwhile, the intensified rack board 55 can be rotatively bonded to the first bonding portion 462 by the second bonding portion 553 of the same side and the bolt 464.

Figure 3B:
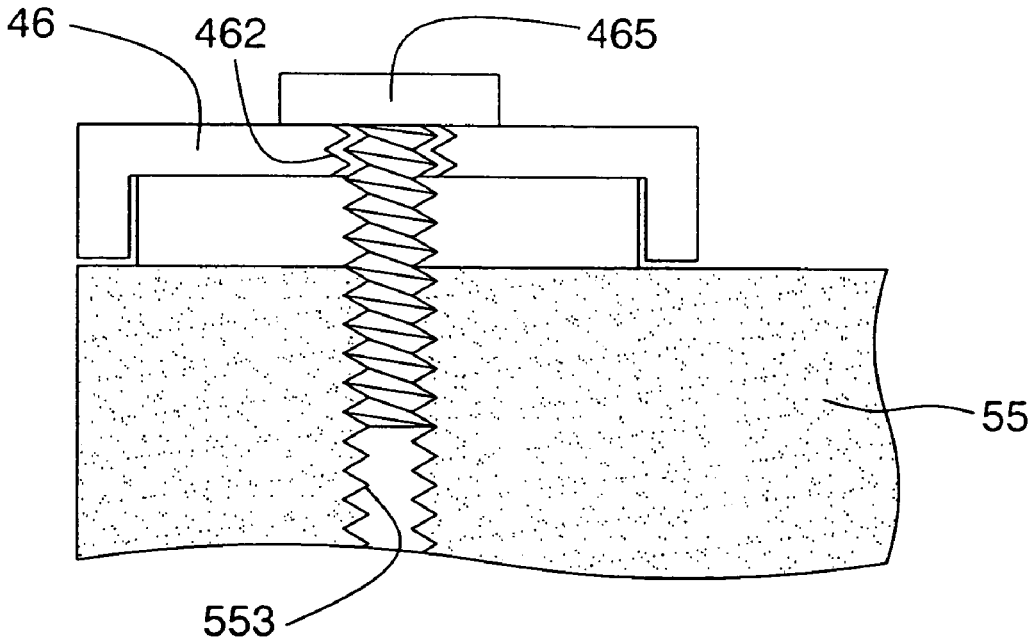

As shown in FIG. 3B, when the intensified rack board 55 is formed as an back board, the first bonding portion 462 of the expansion material 46 is also a big screw and the second bonding portion 553 of the intensified rack board 55 is a small screw for a bolt 465 passing through the first bonding portion 462 and bonding to the second bonding portion 553. Meanwhile, the intensified rack board 55 can be bonded to the first bonding portions 462 set on the two sides of the expansion material 46 by the second bonding portions 553 and the bolt 465 to form a back board.

Figure 3C:
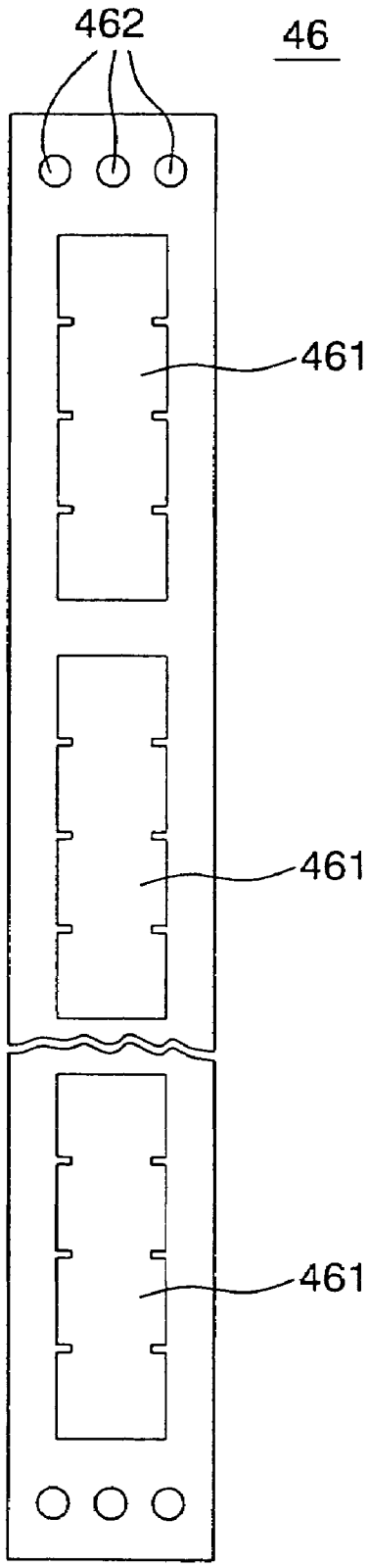
FIG. 3C is a cross-sectional view showing an embodiment of the expansion material of the present invention.

Additionally, one third through hole 461 of the expansion material 46 is illustrated for penetrating the serial joint material 39 in the above, however the length of the expansion material 46 and the amount of the third through hole can be changed according to practical expansion demands. As shown in FIG. 3C, a plurality of third through holes 461 are spatially arranged on a face of the expansion material 46*a*, for example, two, three or more, certainly the space of the third through holes 461 must accord with the width of the erect rack board 3. Moreover, a plurality of the first bonding portions 462 such as screws may also be set symmetrically near the two sides for elastic variations of the intensified rack board 55.

Figure 4A:
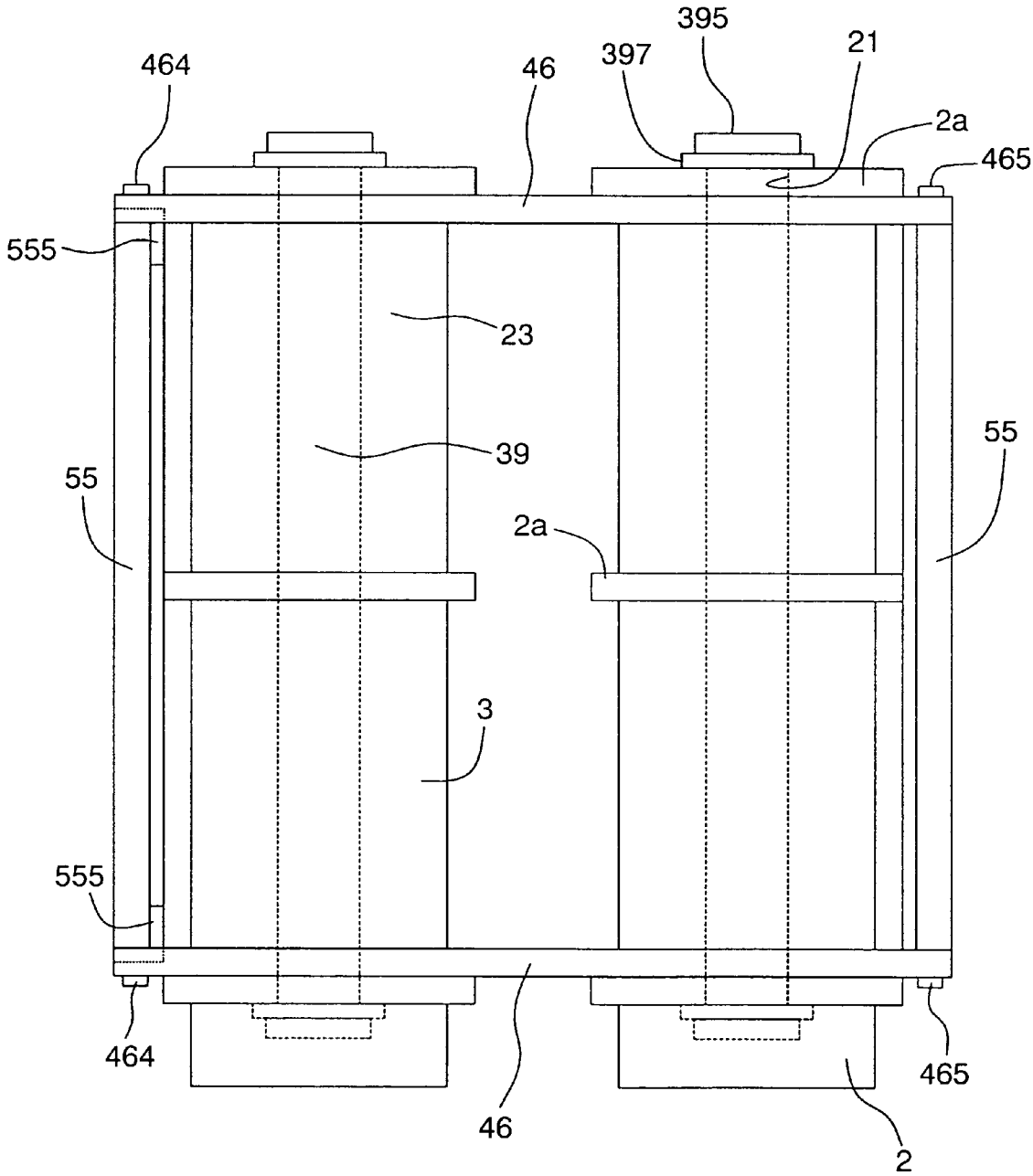
FIG. 4A is a cross-sectional showing a second embodiment using the combined rack of the present invention.
Figure 4B:
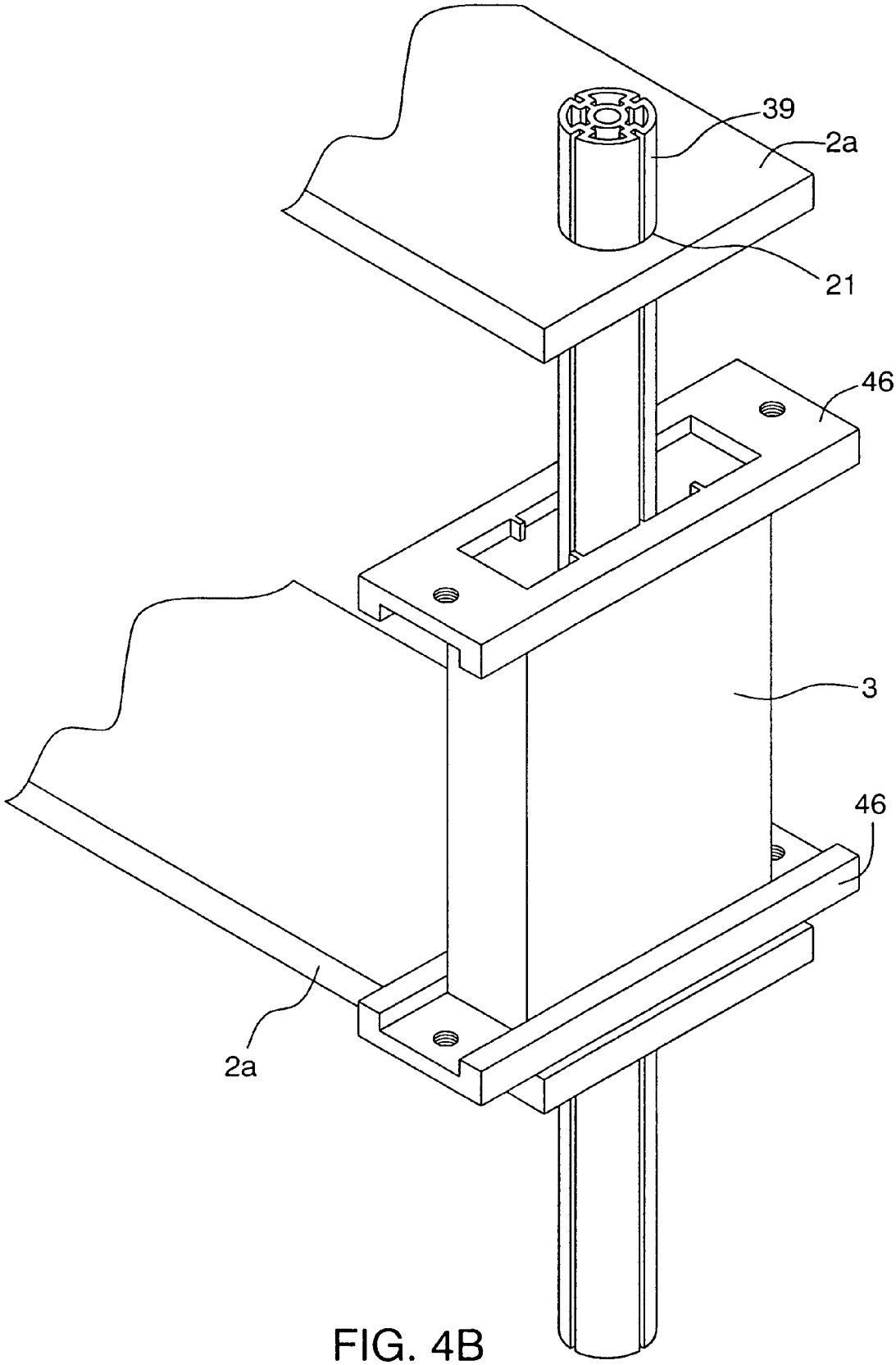
FIG. 4B is a cross-sectional showing a third embodiment using the combined rack of the present invention.

A combined rack having a plurality of frame units shown in FIG. 4A or FIG. 4B may be formed by the combined components assembly of the present invention according to practical demands.

As shown in FIG. 4A, proper length, width, amount of the lateral rack boards 2(2*a*), the erect rack boards 3, the serial joint materials 39, the expansion materials and the intensified rack boards 55 are selected after the height, weight and interlayer number of the combined rack is decided. Wherein, the first through holes 21 are drilled firstly near two sides of the face of the lateral rack board, the amount and height of the erect rack board 3 may vary with the height of the interlayer, and the length of the serial joint material 39 is a little smaller than or equal to the height of the combined rack.

After the lateral rack boards 2(2*a*), the erect rack boards 3 and the expansion materials 46 are serially connected by the serial joint materials 39, the lateral rack boards 2(2*a*) and the erect rack boards 3 can be bonded and fixed tightly to form a combined rack with a plurality of stacking frame units by use of screwing the bonding components 395 such as bolts and the gaskets 397. Then the intensified rack board 55 is fixed between the four expansion materials 46 at the backside of the combined rack with bolts 465 to form a back board of the combined rack. In addition, another intensified rack board 55 is axially connected to the front side of the combined rack to form an active door with bolts 464 and a door stop 555 may be fixed to one side of the expansion material 46 which is not connected to the bolt 464. In this embodiment, two intensified rack boards used as a back board and an active door are illustrated, and the height of the intensified rack board accords with the combined racket, but they are not limited thereto.

As shown in FIG. 4B, when the serial joint materials 39 penetrate the lateral rack boards 2*a*, the erect rack boards 3 and the expansion materials 46, the expansion materials 46 are mounted between the upper and lower sides opposed to the two lateral rack boards 2*a* of the two erect rack boards 3 of one frame unit, so the intensified rack board 55 (not shown in the figure) which has the same height as the erect rack board 3 can be selected.

Figure 5A:
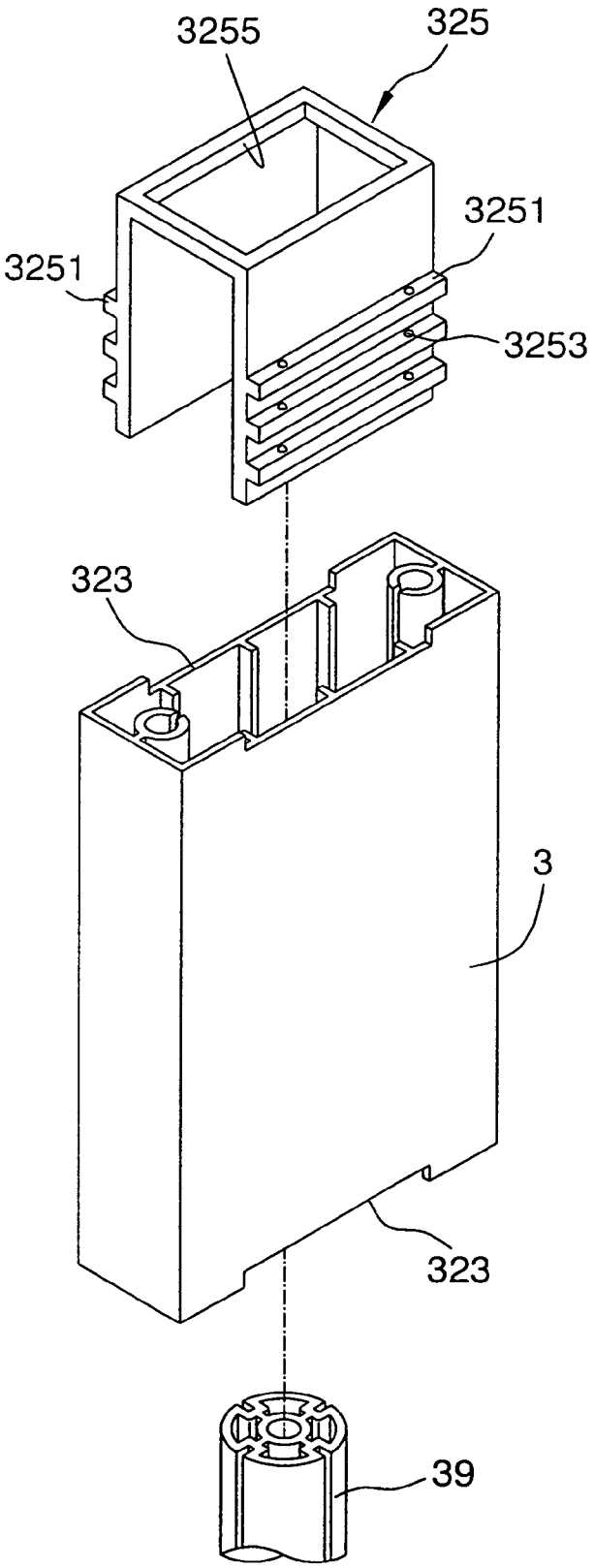
FIG. 5A and FIG. 5B are cross-sectional views showing two combined structures of a clap board rack of the present invention.
Figure 5B:
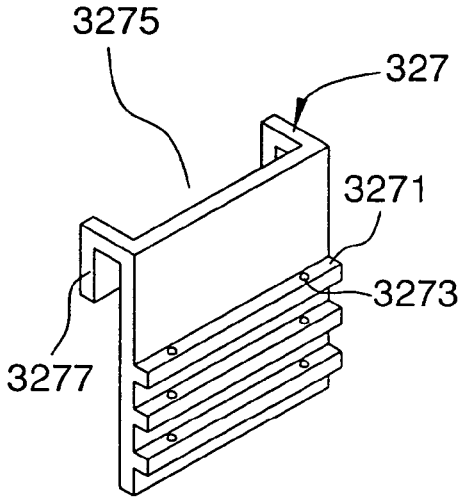

To provide elastic expansion of the combined rack, clap board racks 325, 327 are further added in any frame unit. As shown in FIG. 5A, a stridden slot 323 is preformed on upper and lower sides of the erect rack board 3 by a milling cutter or other tool for the clap board rack 325 which has a ⊓-shaped section to stride over, wherein at least one raised line 3251 is formed on both sides of the clap board rack 325, a stop-slip mat 3523 is set on the raised line 3251, and an opening 3255 for penetrating the serial joint material 39 is further set in the center of the clap board rack 325. In addition, the section structure of the clap board rack 325 is not limited to ⊓-shaped, for example, the section of the clap rack board 327 as shown in FIG. 5B may be L-shaped, wherein at least one raised line 3271 is formed on one side of the clap board rack 327, a stop-slip mat 3573 is set on the raised line 3271, an opening 3275 for penetrating the serial joint material 39 is also set in the center of the clap board rack 327, and barbs 3277 are further formed corresponding to two sides of the opening 3275 in order to prevent the serial joint material from falling out.

Figure 5C:
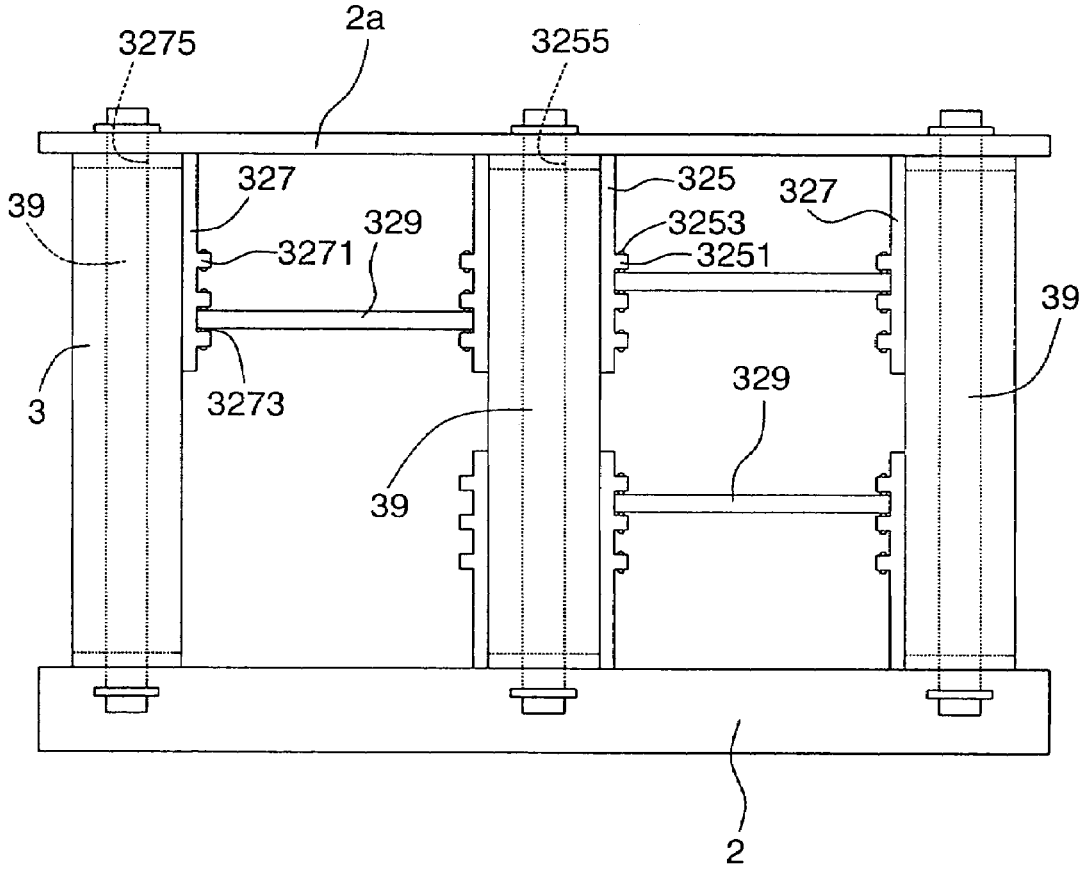
FIG. 5C is a cross-sectional view showing a clap board combined with the clap board racks according to the present invention.

To place objects on the combined rack, the above clap rack boards 325, 327 can be selected to mount on the erect rack board 3. As shown in FIG. 5C, a combined rack with two frame units is formed with two lateral rack boards 2(2*a*), three erect rack boards 3 and three serial joint materials 39. The erect rack boards 3 on two sides of the combined rack are provided for the clap rack board 327 to stride there over, the central erect rack board 3 is provided for the clap rack board 325, and symmetrical raised lines 3251 or the raised line 3271 can be selected for the clap board 329. The clap board 329 is extruded by metal, plastic or the like and can be a plate made of glass, stone and the like.

Figure 6:
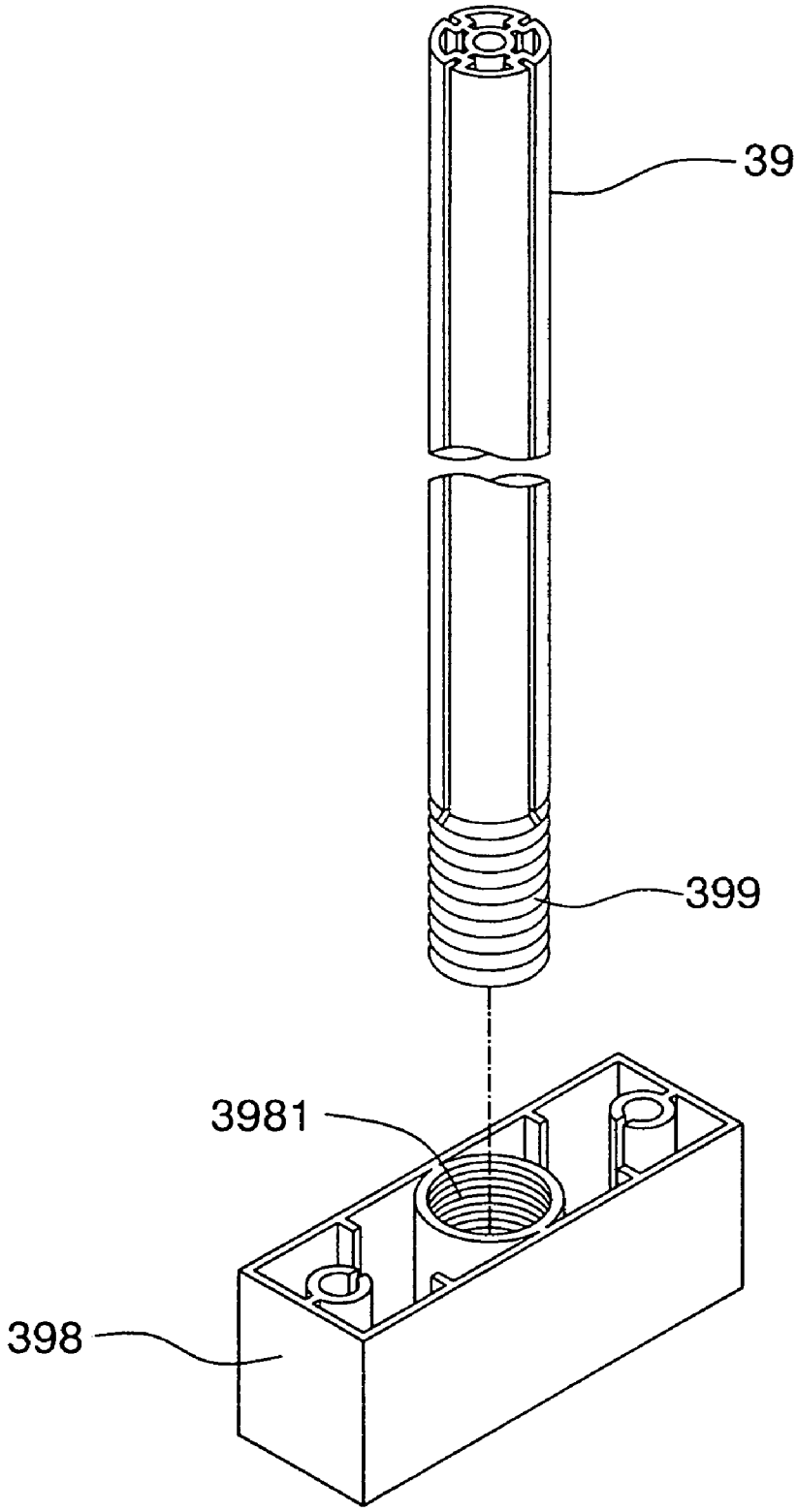
FIG. 6 is a cross-sectional view showing a serial joint material of the present invention.

However, the third bonding portion 393 of the serial joint material is screwed by the bonding component 395 such as a bolt and the gasket 397 in the above embodiment, readjustment function should be designed in consideration of length error in cutting the serial joint material 39. As shown in FIG. 6, outer thread 399 is formed at the bottom segment of the serial joint material 39 by lathe turning for bonding a foot rest 398 with inner thread 3981, and the foot rest 398 is almost the same as the erect rack board 3 in structure except the inner thread 3981 in the center of the foot rest. The foot rest 398 can replace the bonding component 395 and the gasket 397 to bond the serial joint material 39, and the height of the serial joint material 39 can be readjusted in accordance with the inner thread 3981 and the outer thread 399. Furthermore, only the lateral rack boards 2*a* are needed and the lateral rack boards 2 having the mat 22 can be omitted because of the foot rest 398 mounted on the bottom or top of the combined rack. Certainly, the lateral rack board 2 having the mat 22 can also be used to increase the structural intensity.

Figure 7A:
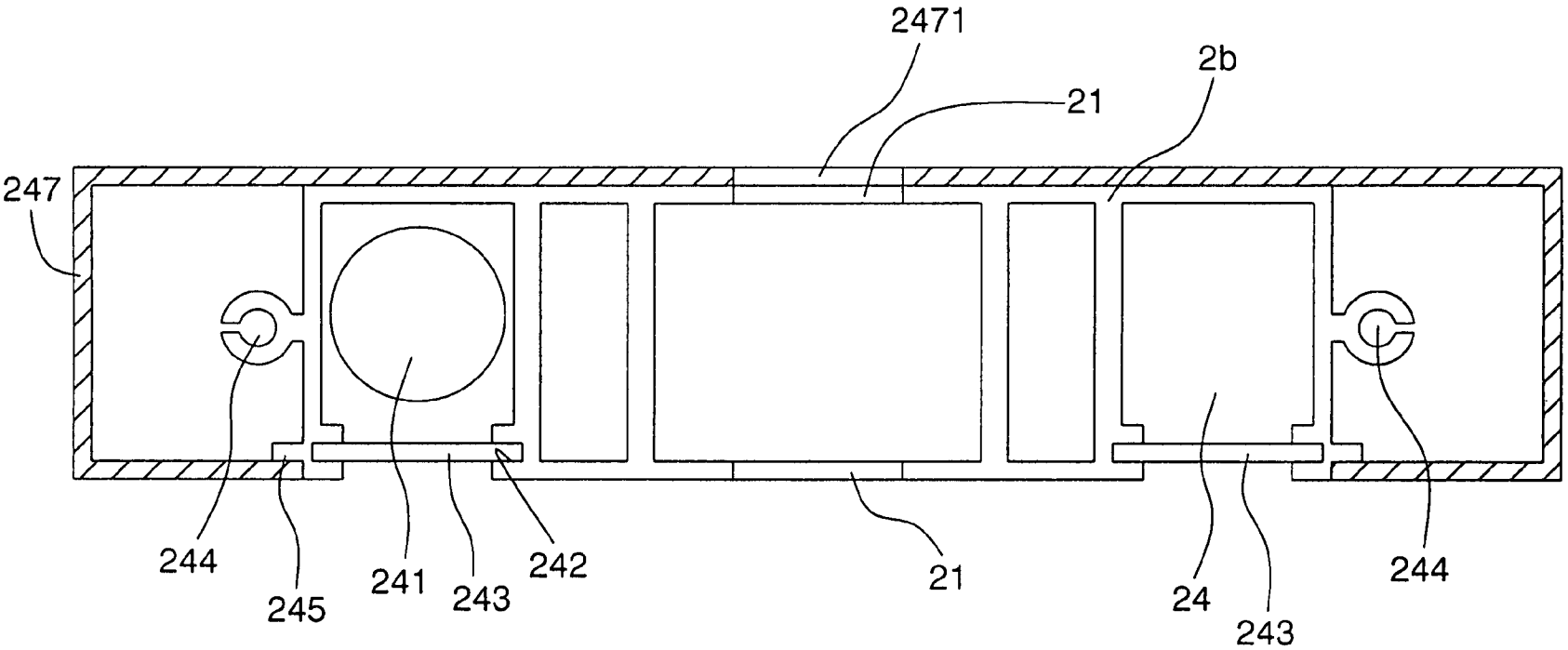
FIG. 7A and FIG. 7B are cross-sectional views showing a lateral rack board of the present invention.
Figure 7B:
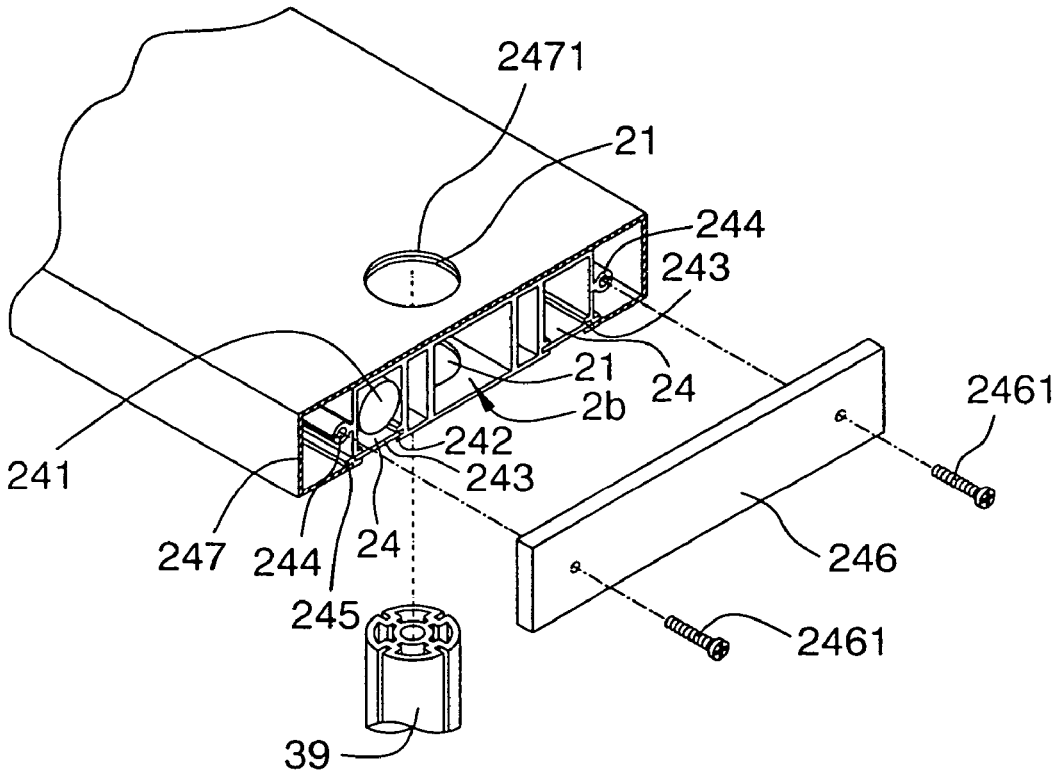

The lateral rack board 2 can also applied on the interlayer of the combined rack for providing width expansion or illumination. Referring to a lateral rack board 2*b* shown in FIG. 7A and FIG. 7B, besides the first through hole 21, the lateral rack board has at least a recess 24 which is opened towards a bottom side for holding a lamp 241 and a slot 242 is set at a bottom edge of the recess 24 for plugging a transparent window board 243. Moreover, an outer frame board 247 having a fourth through hole 2471 for penetrating the serial joint material 39 is bonded to an outside of the lateral rack board 2*b*, and two side closing boards 246 are respectively bonded to two sides of the outer frame board 247. Wherein, screws 244 are set on two sides of the lateral rack board 2*b* for bonding to the side closing boards 246 with bolts 2461, and two lugs 245 are further set on the two sides of the lateral rack board 2*b* for bonding the lateral rack board to a bottom side of the outside frame board 247. The lug 245 can be bonded to the outside frame board 247 by glue or bolt.

To overcome the width limitation caused by metal or plastic extrusion or combined material extrusion, the outer frame board 247 which is formed by bending metal sheet can be used to expand the width of the lateral rack board.

Figure 7C:
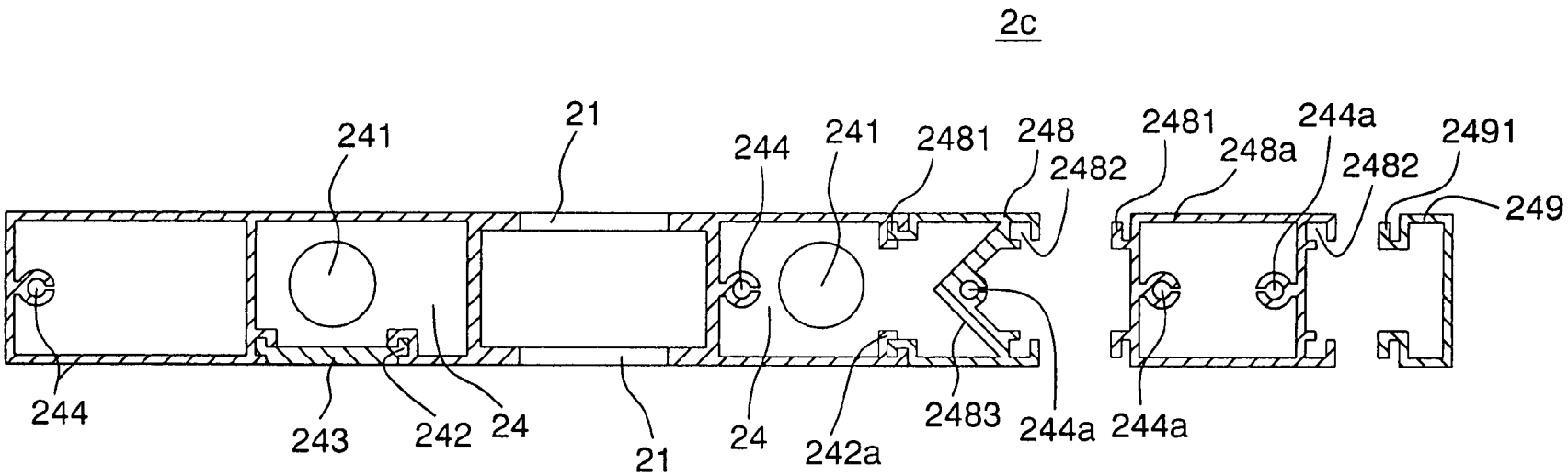
FIG. 7C and FIG. 7D are cross-sectional views showing a lateral rack board according to another embodiment of the present invention.
Figure 7D:
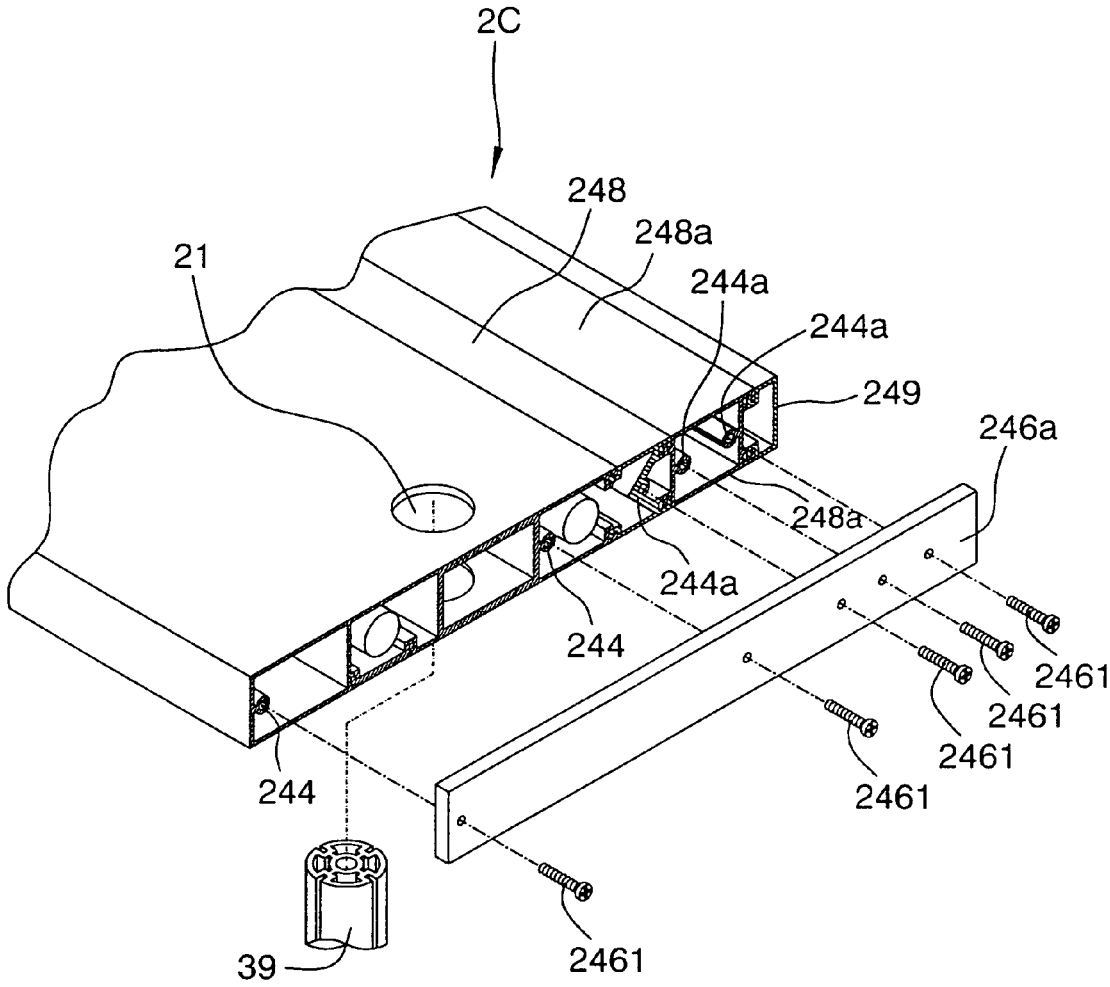

Further, in order to allow the inner layer to have several functions such as width expansion and lightening, the lateral rack board 2*c* may be adopted to a combined form. FIGS. 7C and 7D show a lateral rack board 2*c* having a first through hole 21 formed on both side respectively and a recess 24 opened facing the bottom for placing a lamp 241, wherein the bottom of the recess 24 comprises a slot 242 for inserting a transparent window board 243. Furthermore, one side of the lateral rack board 2*c* comprising a slot 242*a* for expanding and combining with a lateral expansion member 248 having a insertion bar 2481 and a slot 2482. The lateral expansion member 248 may be made of transparent plastic, wherein the inner surface thereof facing the recess 24 is formed as a triangular or rhombic reflective surface 2483 reflecting the light from the lamp 241 to the top and the bottom of the lateral rack board 2*c*, so as to increase the intensity of the light and the lightening area. It should be noted that, the width of the lateral expansion member 248 is not limited by the disclosed drawings; able to lengthen to a width that can be fitted into the lamp 241; able to be replaced by the lateral expansion member 248*a* having the insertion bar 2481 and the slot 2482; able to combine with a side capping 249 having an insertion bar 2491, at the outermost surface thereof.

The lateral rack board 2*c*, lateral expansion member 248 and lateral expansion member 248*a* having screw holes 244 and 244*a* respectively formed thereon may be coupled to a side covering 246*a* with or without screws 2461.

To overcome the width limitation caused by metal or plastic extrusion or combined material extrusion, the lateral expansion member 248 and lateral expansion member 248*a* can be used to expand the width of the lateral rack board 2*c*, thereby removing the limitation of making the devices.

Furthermore, a butt joint material 4 is further included in=the present invention, and a first locked portion such as a dovetail slot is set on at least one side of the erect rack board or the lateral rack board.

Figure 8A:
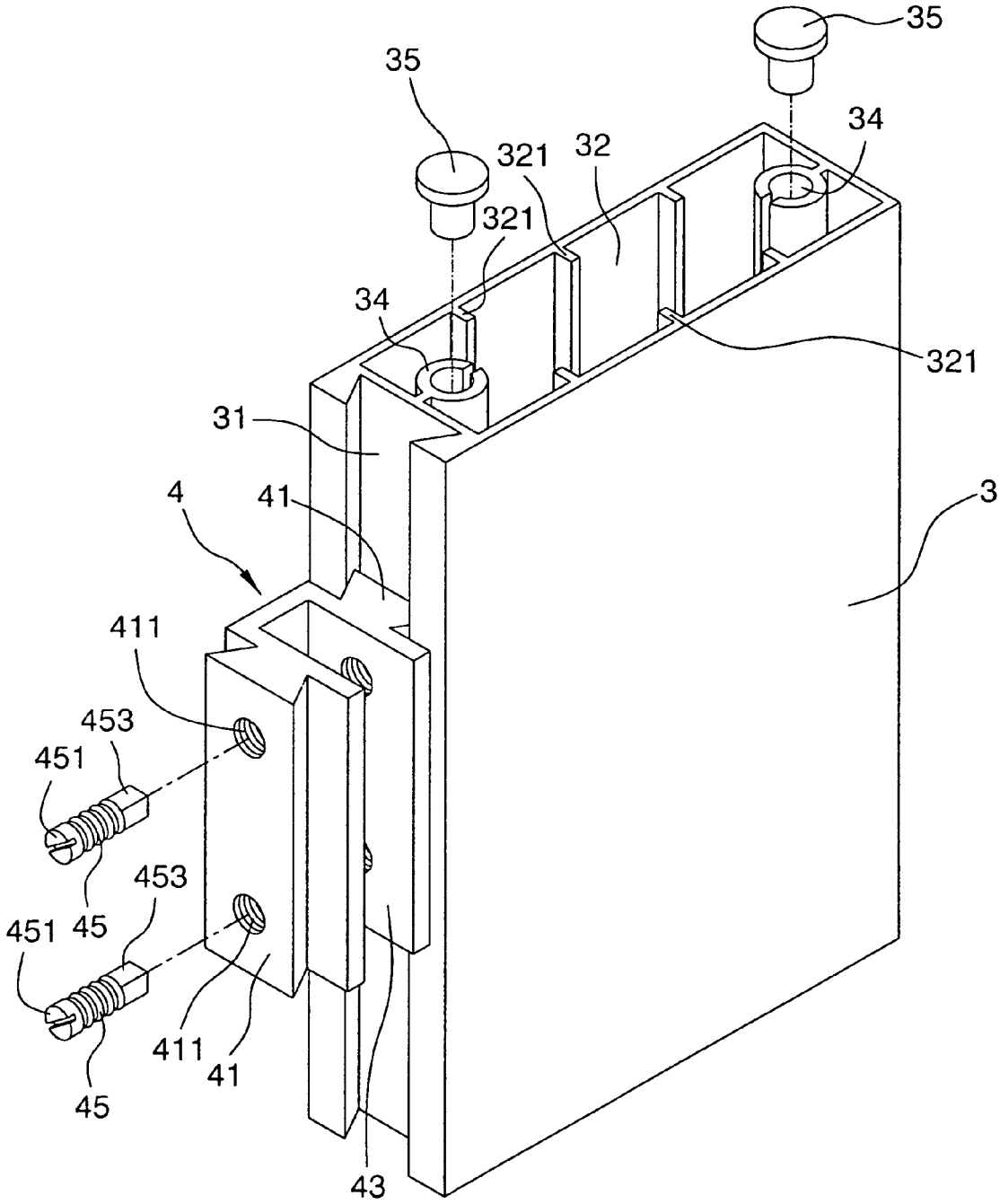
FIG. 8A and FIG. 8B are cross-sectional views showing steps of combining an erect rack board with a butt joint material according to the present invention.
Figure 8B:
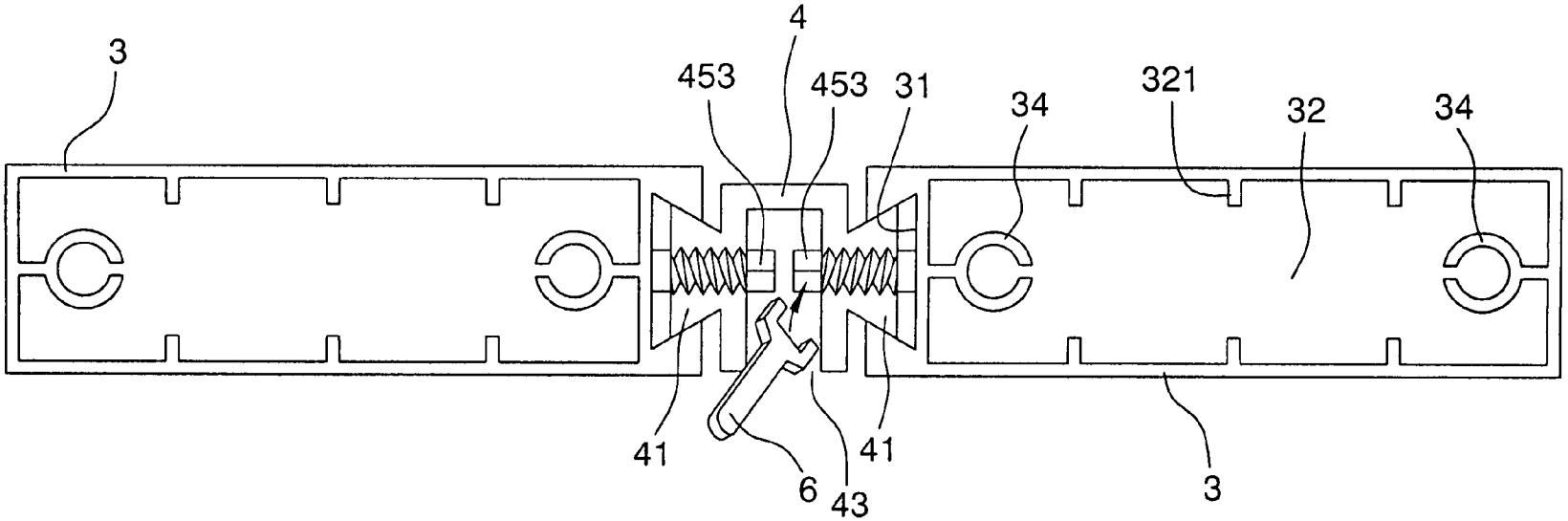

Referring to FIG. 8A and FIG. 8B, two second locked portions 41 such as dovetail blocks are on two sides of the butt joint material 4, a channel is further set to separate the two second locked portions 41, and each of the second locked portions 41 has at least a screw 411 through the channel 43 for screwing a pressure component 45. The pressure component 45 is a dual head fixed screw with a one-shaped groove 451 and a quadrangle angle post 453 on two sides of the dual head fixed screw.

As shown in FIG. 8A, when the butt joint material 4 is bonded to the two erect rack boards 3, firstly the second locked portion 41 on one side of the butt joint material 4 is locked to the first locked portion 31 of one erect rack board 3; then as shown in FIG. 8B, a first locked portion 31 of another erect rack board 3 is locked to another second locked portion 41 of the butt joint material 4, and the angle posts 453 of the pressure component 45 are rotated by a rotated locked tool 6 from the channel to tightly press the groove 451 against the inside of the first locked portion 31, so the first locked portion 31 such as the dovetail slot and the second locked portion 41 such as the dovetail block can be bonded to each other tightly because of the reaction force cause by the first locked portions 31 of the two erect rack boards 3 away from the second locked portions 41 of the butt joint material 4.

However, it should be understood to those in the art that the pressure component 45 is not limited to the present invention, for example, the groove 451 may be a cross-shaped groove and the angle post 453 may be a hexagon angle post. Meanwhile, the amount and space of the screws 411 and the pressure components 45 can be decided by height (length) proportion.

Additionally, besides the second through hole 32 and the first fixed portion 321 such as a rib, the erect rack board 3 further includes a jack 34 for plugging a non-slip mat 35 such as rubber or plastic which has antislip character and flexibility. Therefore, buffer and shockproof effect of a joint face between the erect rack board 3 and the lateral rack board 2 are provided, and the joint face can be prevented from sliding away even if the second through hole 32 is not good processed.

Figure 9:
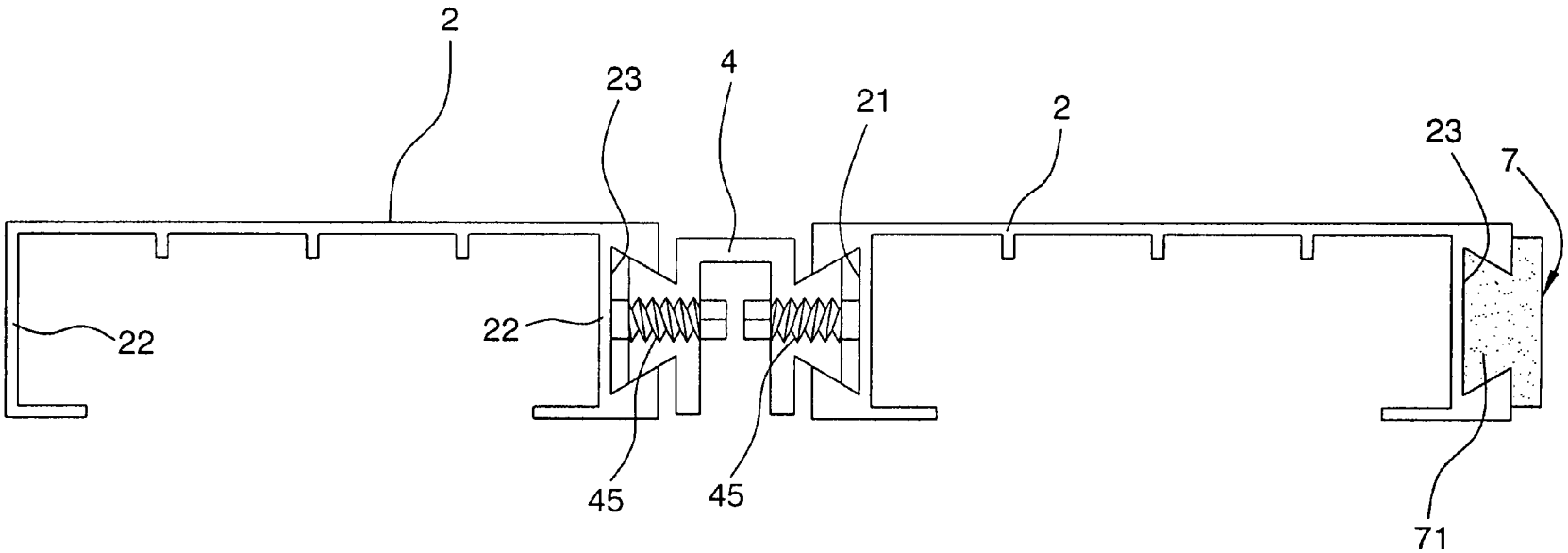
FIG. 9 is a cross-sectional view showing a combination of a lateral rack board with a butt joint material.

Moreover, the butt joint material 4 can also be used to connect two lateral rack boards 2. As shown in FIG. 9, same first locked portions 23 are formed at one mat 22 or opposed to two mats 22 of the lateral rack board 2. The locking step of the pressure component 45 by the butt joint material 4 has described in the above, so it is not repeated herein. A ribbon 7 having a second locked portion 71 is further used to cover unused first locked portion 23, and figure or color is printed on the surface of the ribbon to decorate the lateral rack board 2. Certainly, the use of the ribbon 7 is not limited to the lateral rack board 2, i.e. the ribbon can be used in anywhere having the first locked portion.

Figure 10:
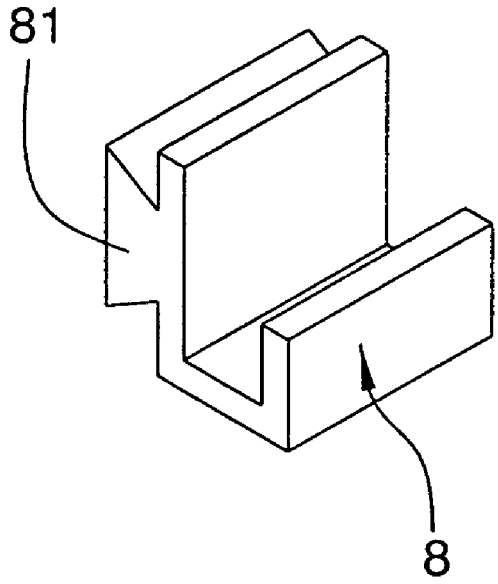
FIG. 10 is a cross-sectional view showing a hook material of the present invention.

Referring to FIG. 10, the combined components assembly of the present invention further comprises a hook material 8 having a second locked portion 81 which can be locked to the first locked portion 23 of the lateral rack board 2 for providing object hanging function. Certainly, screws through the second locked portion 81 for screwing the pressure component as described above can also be set.

Figure 11A:
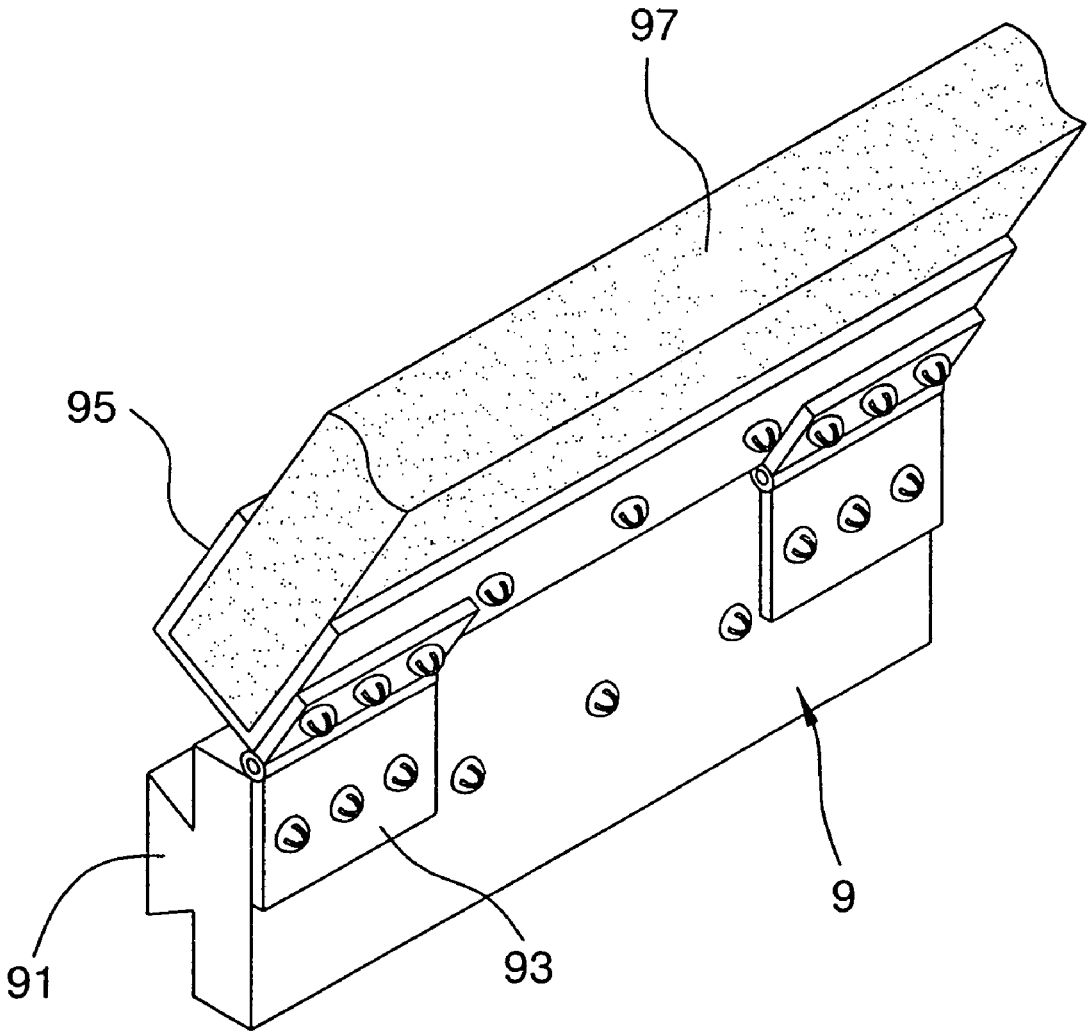
FIG. 11A and FIG. 11B are cross-sectional viewing showing two embodiments of a hinge material of the present invention.
Figure 11B:
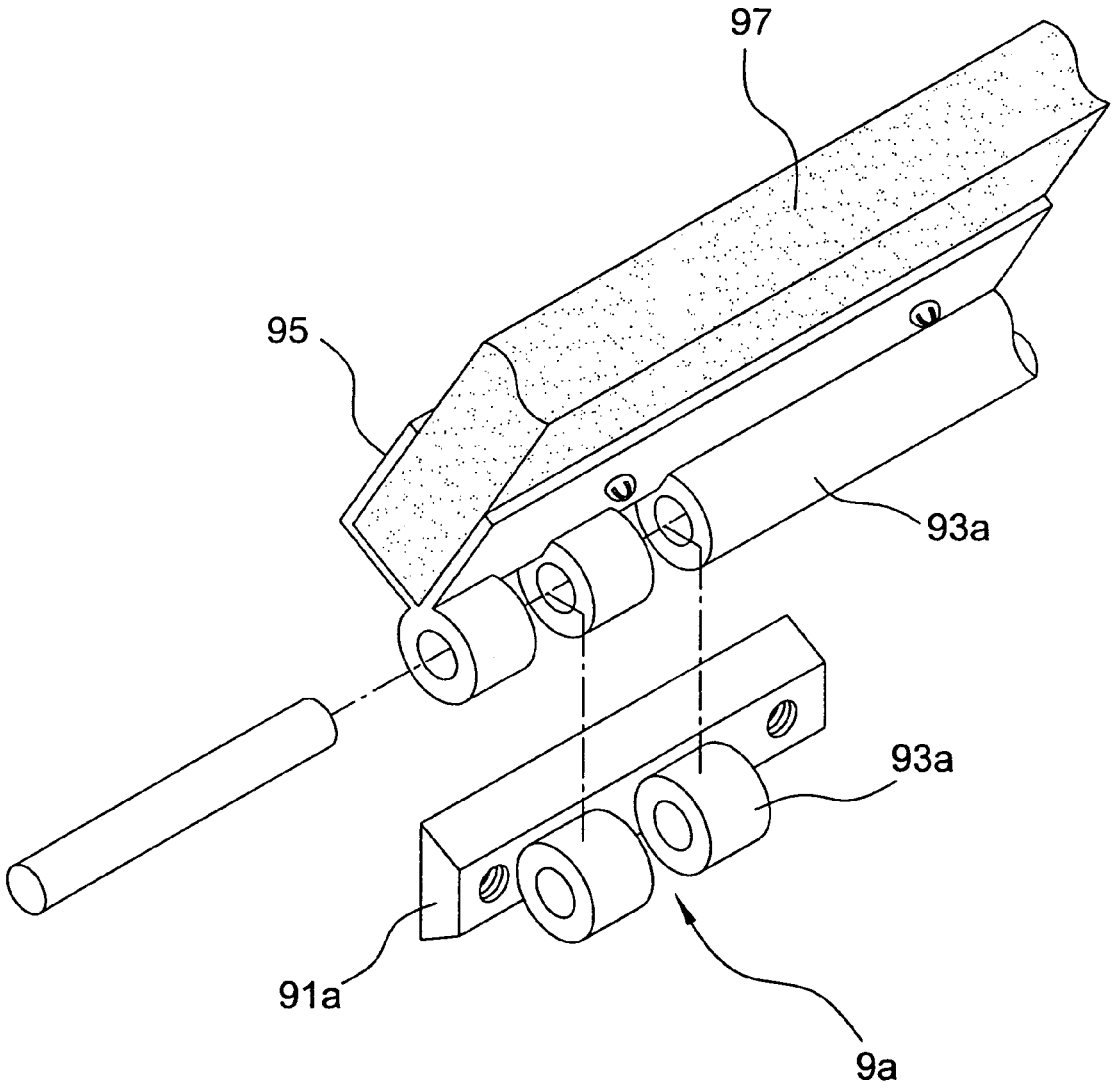
Figure 11C:
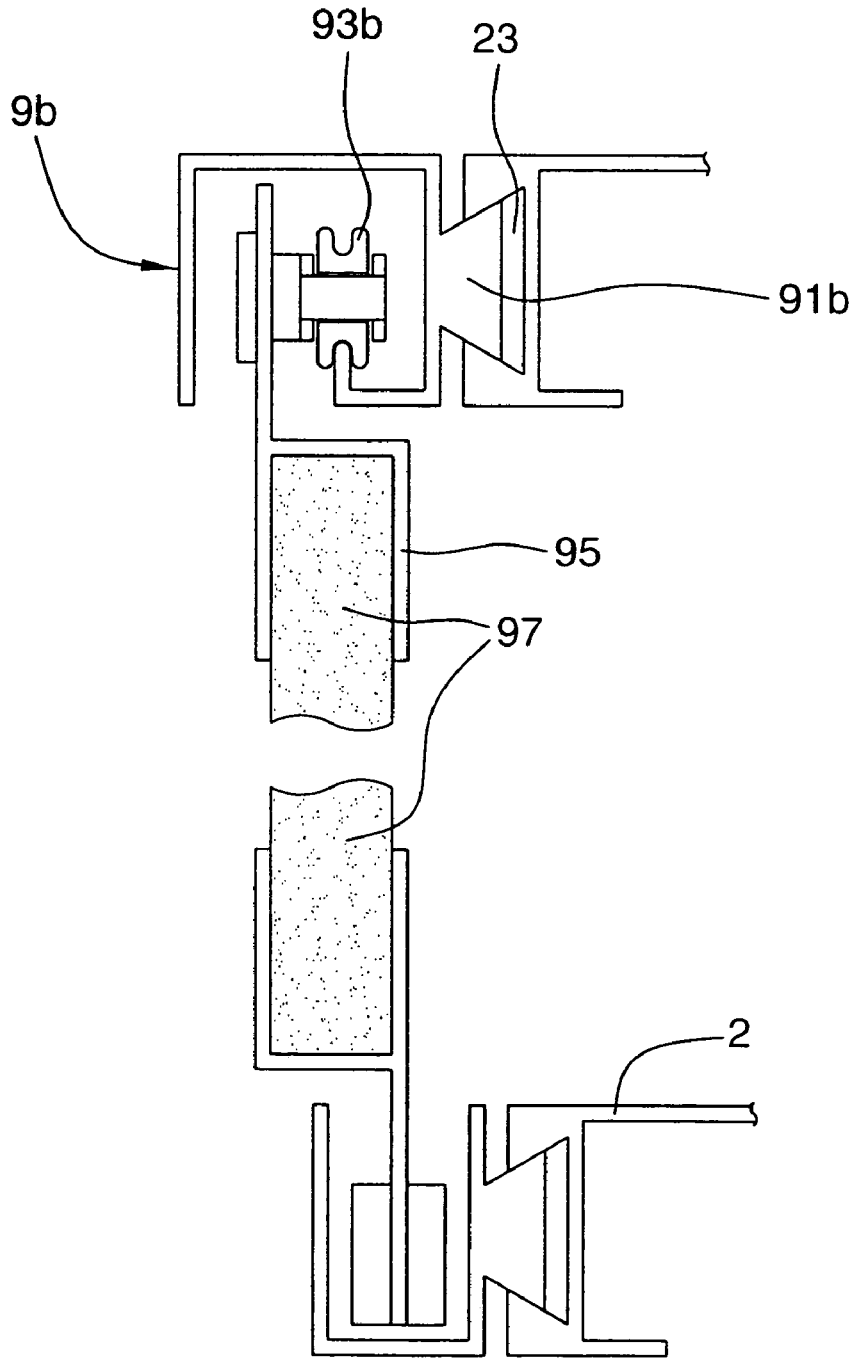
FIG. 11C is a cross-sectional view showing a slide-rail material of the present invention.

Referring to FIG. 11A, the combined components assembly of the present invention further comprises a hinge material 9 having a second locked portion 91. The hinge material 9 can be locked to a hinge 93, and then bond to a door plank 97 by the hinge 93 or a bar 95. The second locked portion 91 of the hinge material 9 can be locked to the first locked portion of the lateral rack board 2 or the erect rack board 3. At the same time, the hinge material 9 can be designed as a combined structure which is shown in FIG. 11B, and a second locked portion 91*a* and a bar 95 are formed on the hinge 93*a* of the combined structure to make the hinge 93*a* simpler and more beautiful. Further, as shown in FIG. 11C, the combined components assembly of the present invention further comprises a slide-rail material 9*b* having a second locked portion 91*b* for locking to the first locked portion 23 of the lateral rack board 2. The slide-rail material 9*b* is used for hanging a bar 95 with a pulley block 93*b* and bonding to a door plank 97 by the bar 95, thereby a slide door can be formed with the pulley block 93*b* and the slide-rail material 9*b*.

Figure 12A:
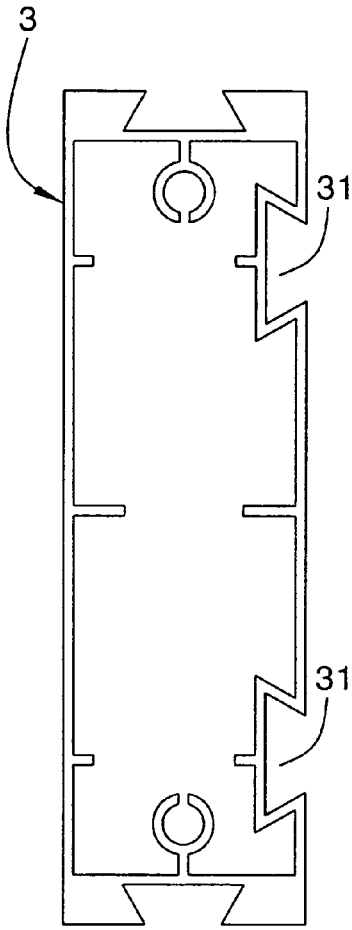
FIG. 12A, FIG. 12B and FIG. 12C are cross-sectional views showing three embodiments of an erect rack board of the present invention.
Figure 12B:
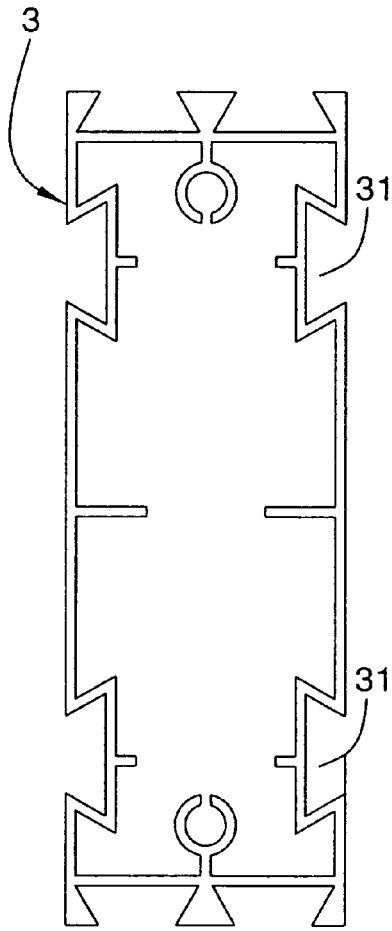
Figure 12C:
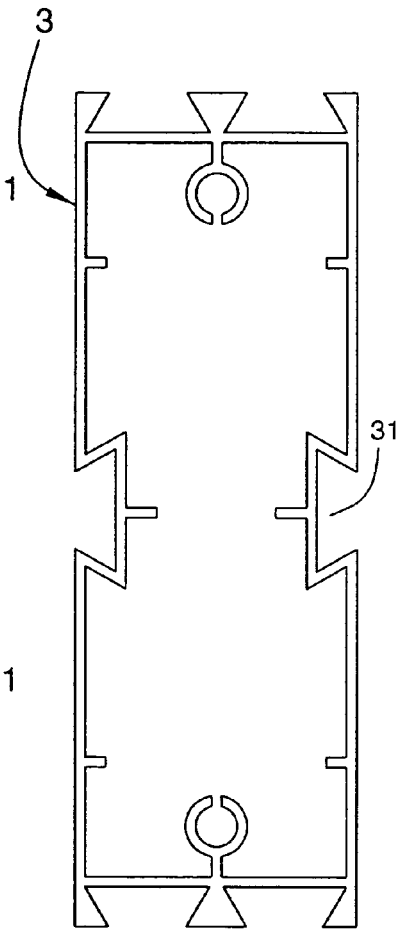

To provide various expansion functions by assembling the above-mentioned hook material 8, the hinge material 9 or the like, a plurality of the first locked portion 31 of the erect rack board 3 or the lateral rack board 2 can be set. As shown in FIG. 12A, FIG. 12B and FIG. 12C, a plurality of the first locked portions 31 are set one each side or one side of the erect rack board 3.

Figure 13A:
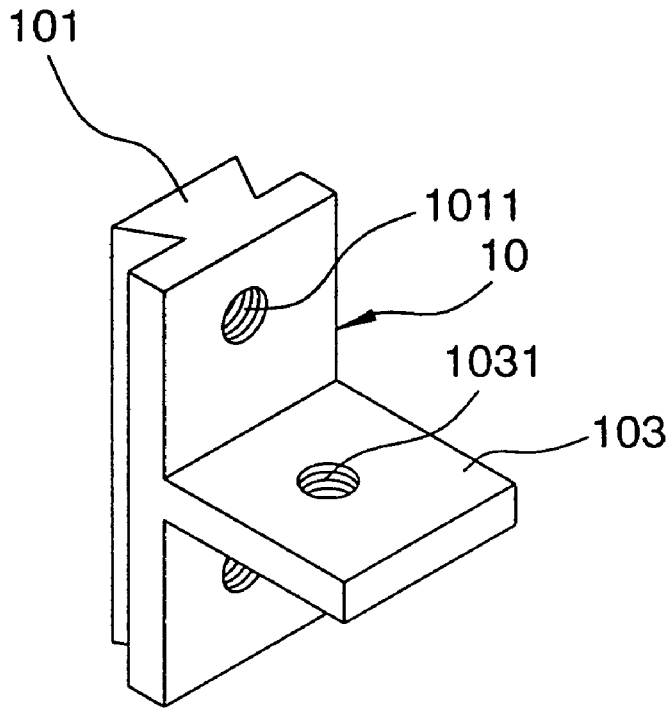
FIG. 13A and FIG. 13B are cross-sectional views showing a structure and a using state of a bearing material of the present invention.
Figure 13B:
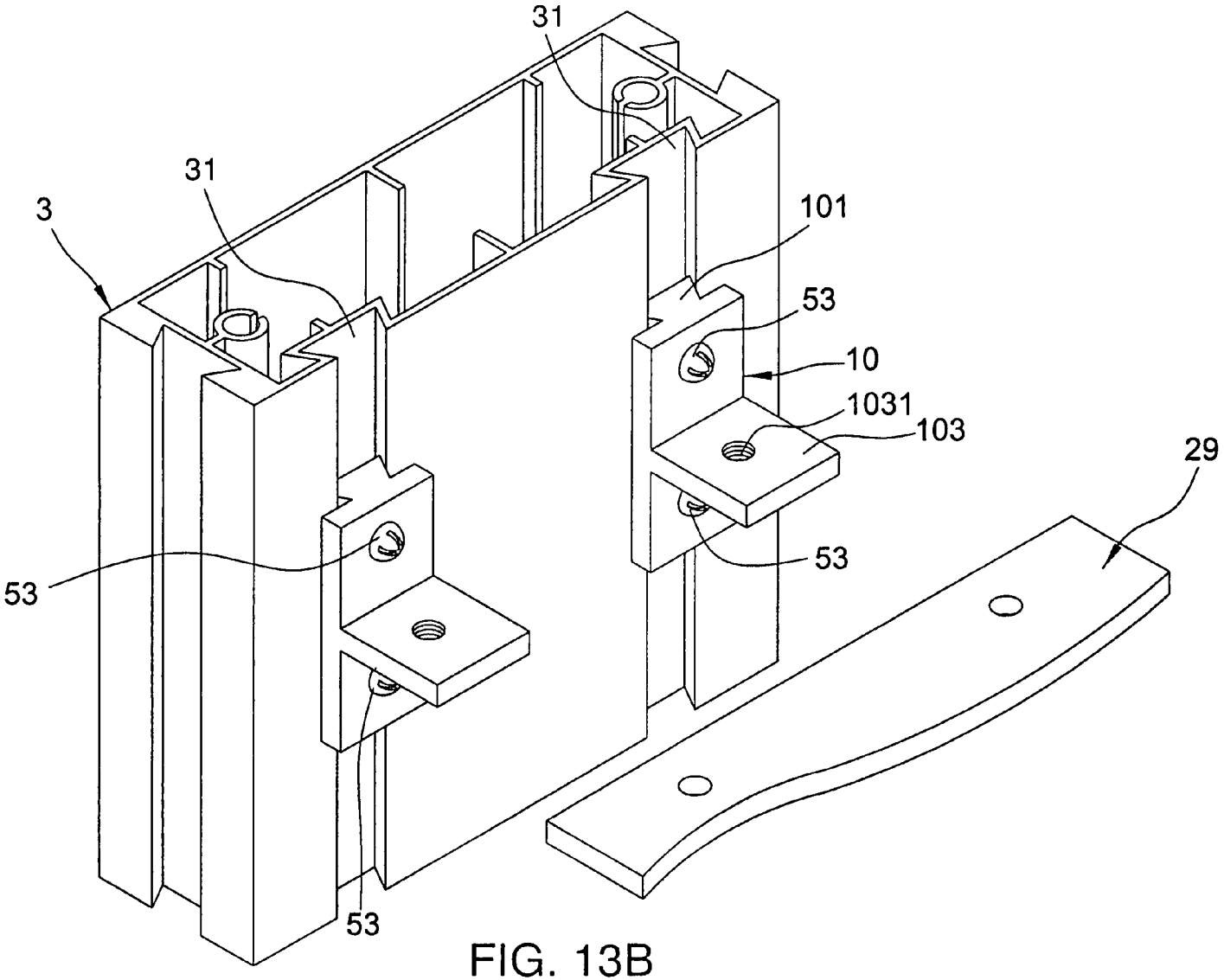

Referring to FIG. 13A and FIG. 13B, the combined components assembly of the present invention further comprises a bearing material 10 having a second locked portion 101. The bearing material 10 further includes a projecting pallet 103 and a through screw 1031 set on a surface of the pallet, and the second locked portion further includes a through screw 1011. The bearing material 10 can be locked to the first locked portion 31 by the second locked portion 10 and fixed tightly with the pressure component 53, wherein the pallet 103 can be used to bear the plate such as a clap board 29.

Figure 14A:
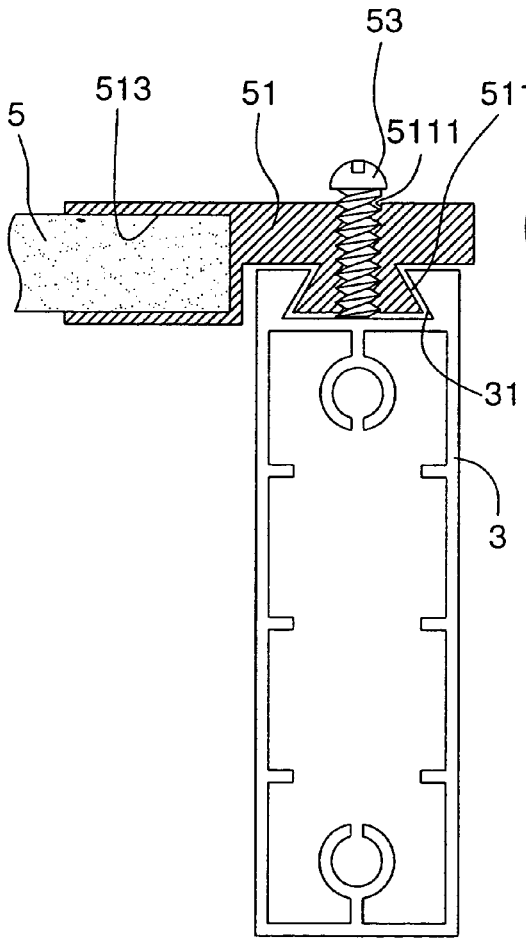
FIG. 14A and FIG. 14B are cross-sectional views showing steps of combining the erect rack board to a back rack board according to the present invention.
Figure 14B:
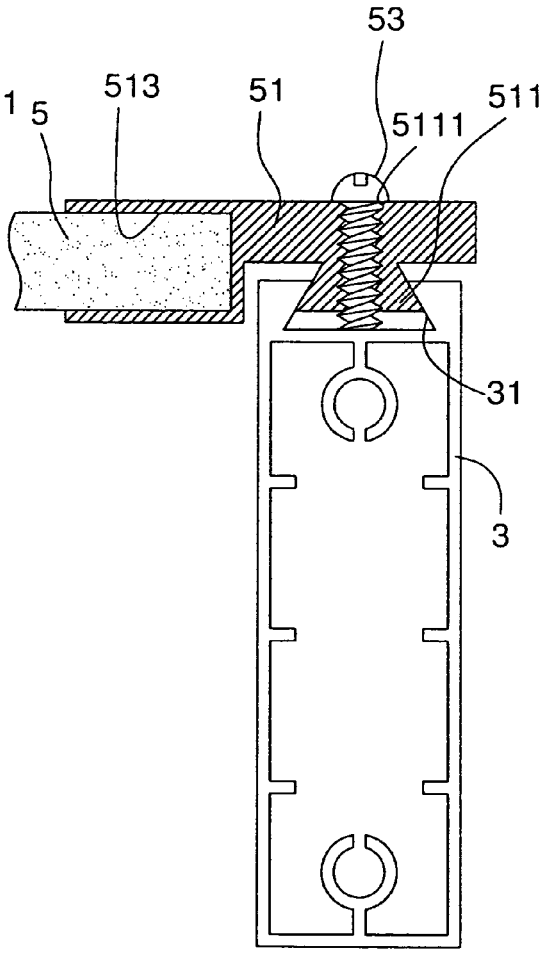

Referring to FIG. 14A and FIG. 14B, the combined components assembly of the present invention further comprises a back rack board 5 with proper intensity which is made of glass, wood, metal or the same material as the lateral rack board 2 and the erect rack board 3. The back rack board 5 is set at a back side of the combined rack and two relative sides of the back rack board 5 are bonded to corner materials 51, wherein a second locked portion 511 such as a dovetail block is set at one side of the corner material 51 for locking to the first locked portion 31 of the erect rack board. Additionally, the corner material 51 further includes a clipping hole 513, and may have at least a through screw (not shown) set on the clipping hole 513 for screwing a pressure component such as a bolt and clipping the comer material to the two sides of the back rack board 5, thereby the back rack board 5 can be bonded in the clipping holes 513 by the pressure components.

Besides the clipping hole 513 and the screw, the corner material 51 further has a screw 5111 through the second locked portion 511 for screwing a pressure component 53. Stable connection can be set when the first locked portion 31 of the erect rack board 3 is locked to the second locked portion 511 of the corner material; and when the pressure component 53 is further locked in and tightly pressed against the inside of the first locked portion 31, the first locked portion 31 such as the dovetail slot and the second locked portion 41 such as the dovetail block can be bonded to each other tightly because of the reaction force cause by the second locked portions 511 away from the first locked portions 31.

Figure 15A:
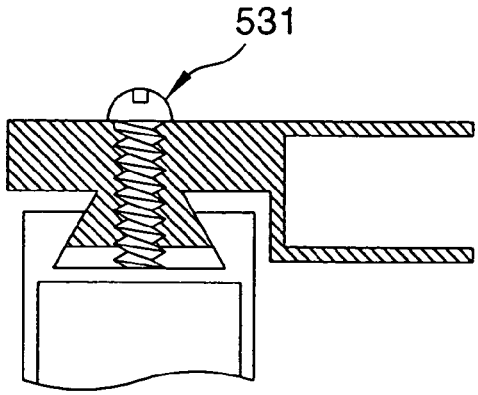
FIG. 15A to FIG. 15E are cross-sectional views showing five embodiments of a pressure component of the present invention.
Figure 15B:
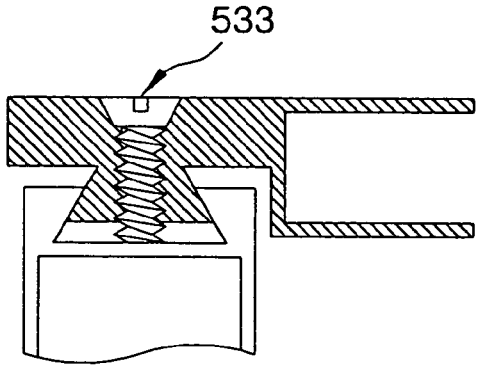
Figure 15C:
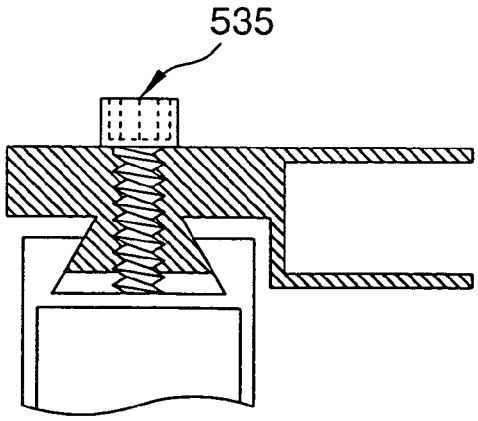
Figure 15D:
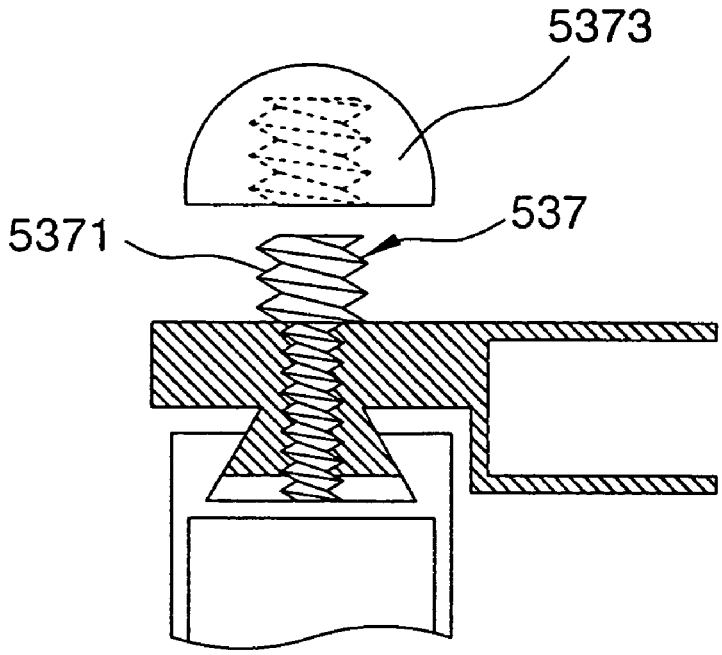
Figure 15E:
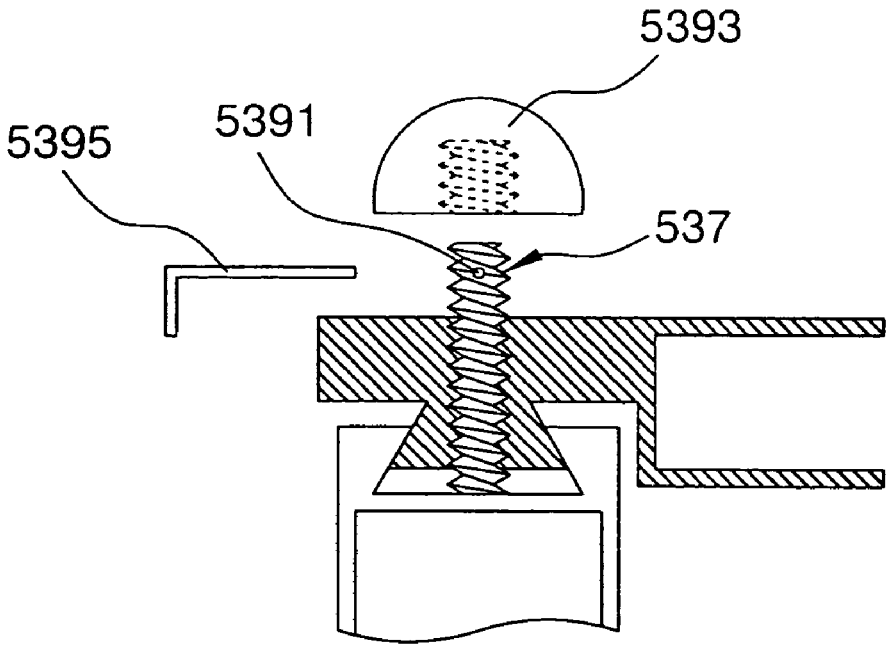

The pressure component 53 may be a cup head screw 531 as shown in FIG. 15A, it can also be a sunk screw 533 as shown in FIG. 15B or a hexagon socket head cap screw 535 as shown in FIG. 15C. Moreover, to enhance the aesthetic property of the combined rack, another hexagon socket head cap screw 537 as shown in FIG. 15D can be used, wherein outer thread 5371 is on the head of the screw for bonding a capping sheet 5373 having inner thread; or a grub screw 539 as shown in FIG. 15E can be used, wherein the grub screw 539 has at least two jacks 5391 for turning over by a rod-shaped tool 5395 and a capping sheet 5393 bonded on the head of the grub screw.

Figure 16A:
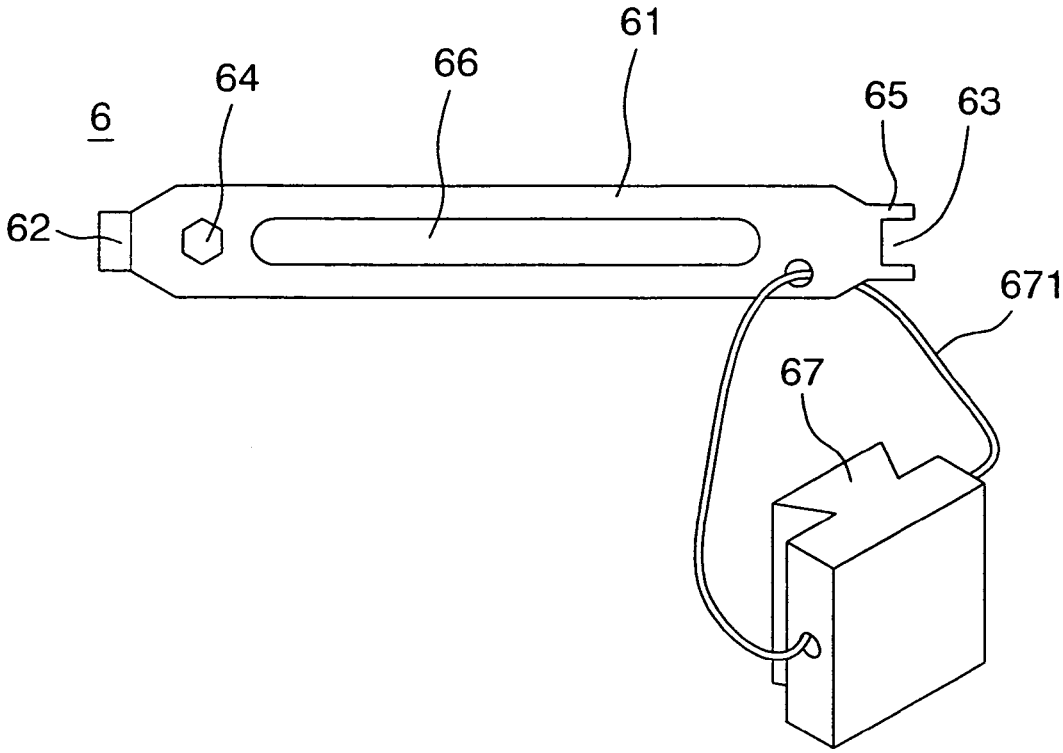
FIG. 16A and FIG. 16B are cross-sectional views showing two embodiments of a rotated locked tool of the present invention.
Figure 16B:
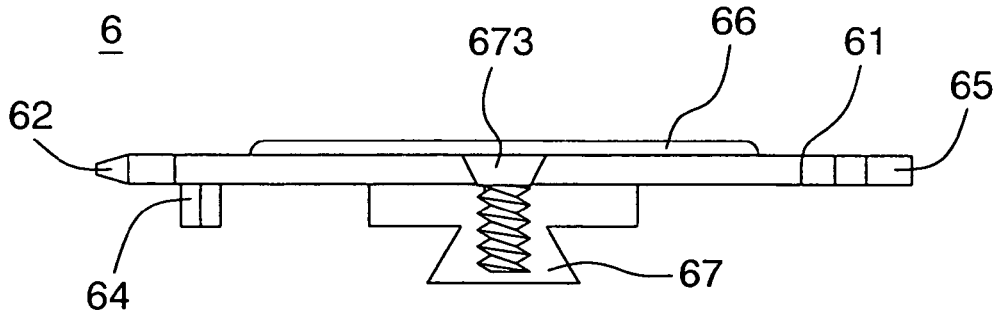

As shown in FIG. 16A, a special rotated locked tool 6 is further comprised in the present invention for providing convenience of assembling operation. The rotated locked tool 6 includes a metal sheet 61 with at least a one-shaped rotated locked end 62, an outside-angle rotated locked end 63, an inside-angle rotated locked end 64 and a rod rotated end 65 formed thereon for turning the pressure components 45, 53. The metal sheet 61 may be a stainless steel sheet having an intensified bearing rib 66 on its surface and a second locked portion 67 such as a dovetail block. The second locked portion 67 is tied to the metal sheet 61 of the rotated locked tool 6 by a cord 671, or locked to the surface of the metal sheet 61 by a bolt 673 as shown in FIG. 16B. The rotated locked tool 6 can be locked to any of the first locked portions 23, 31 by the second locked portion 67, accordingly the rotated locked tool 6 can be saved on the combined rack and for providing expansion or assembling use.

Figure 17A:
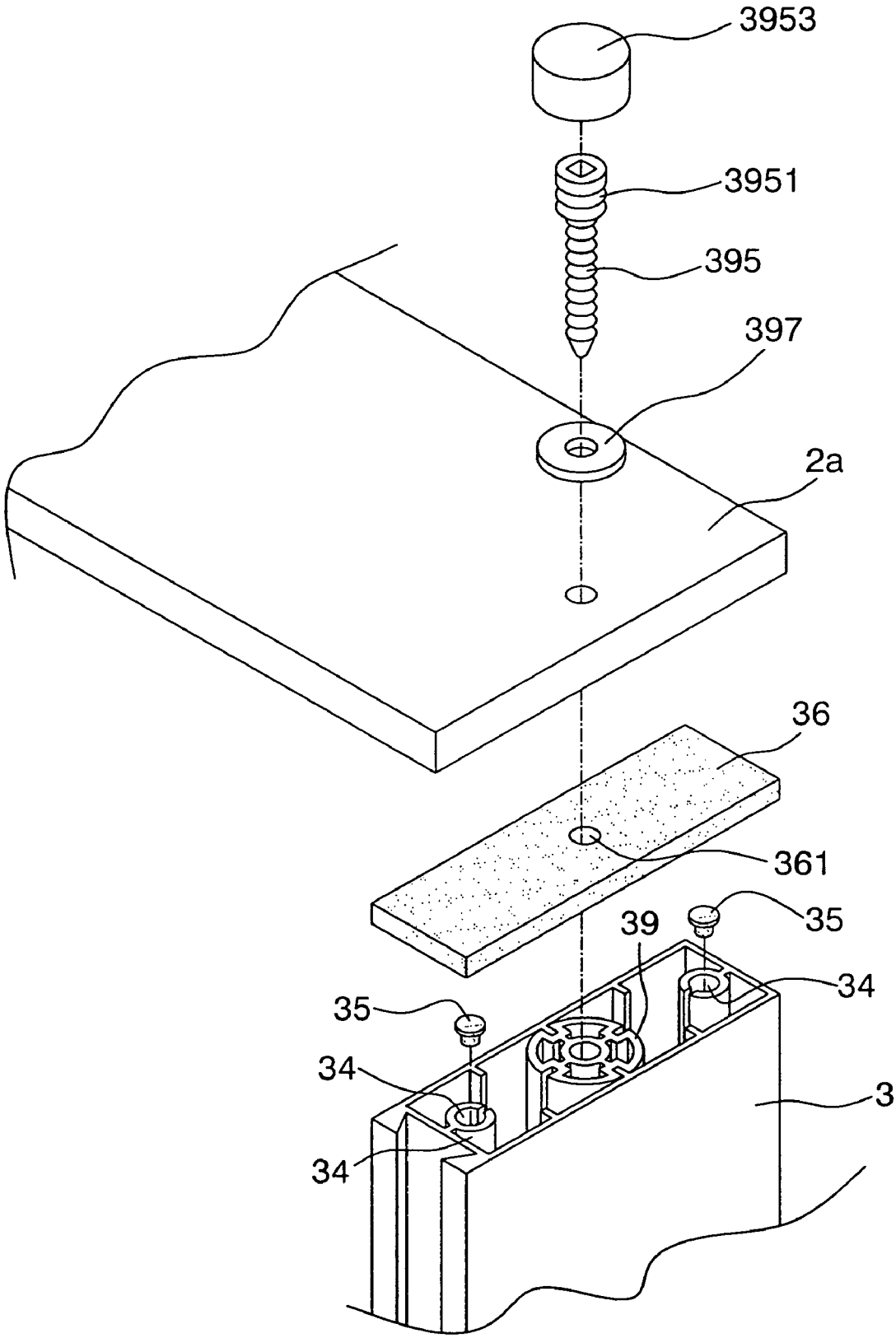
FIG. 17A and FIG. 17B are cross-sectional views showing a bonding component such as a spacer added on a joint face between the erect rack board and the lateral rack board.
Figure 17B:
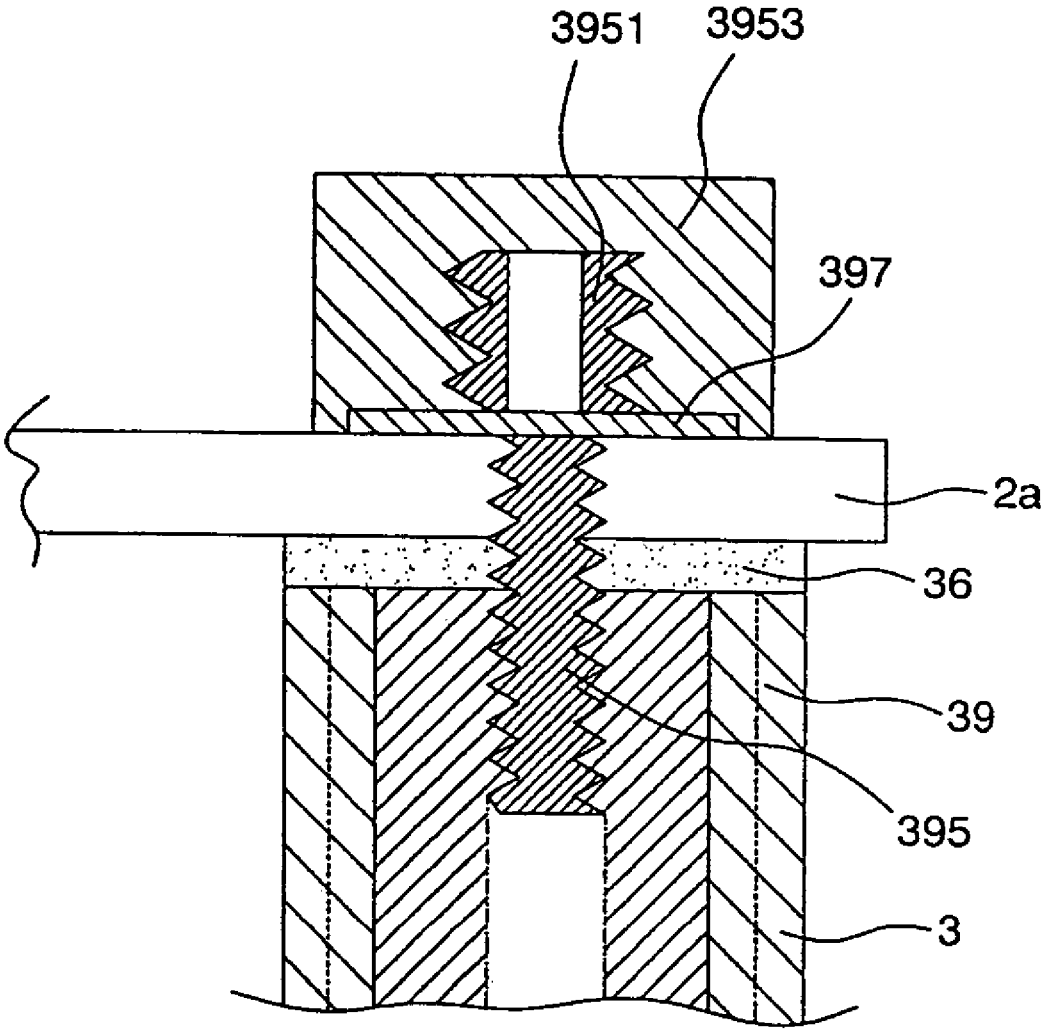

As shown in FIG. 17A and FIG. 17B, to enhance the stability and aesthetic property of the combined rack, the non-slip mat 35 may be employed for plugging into the jack 34. If the lateral rack board 2*a* on a top face is made of transparent material such as glass, a spacer 36 is further set on a joint face between the erect rack board 3 and the lateral rack board 2*a* for covering a top face of the erect rack board 3 besides of the non-slip mat 35 plugging into the jack 34 of the erect rack board 3, certainly the spacer 36 should accord with the opening 361 of the bonding component 395. Furthermore, the bonding component 395 may be the pressure component 53 such as a hexagon socket head cap screw, and the pressure component 53 has outer thread 3951 on its head screwed with a capping sheet 3953 having the corresponding inner thread.

Figure 18A:
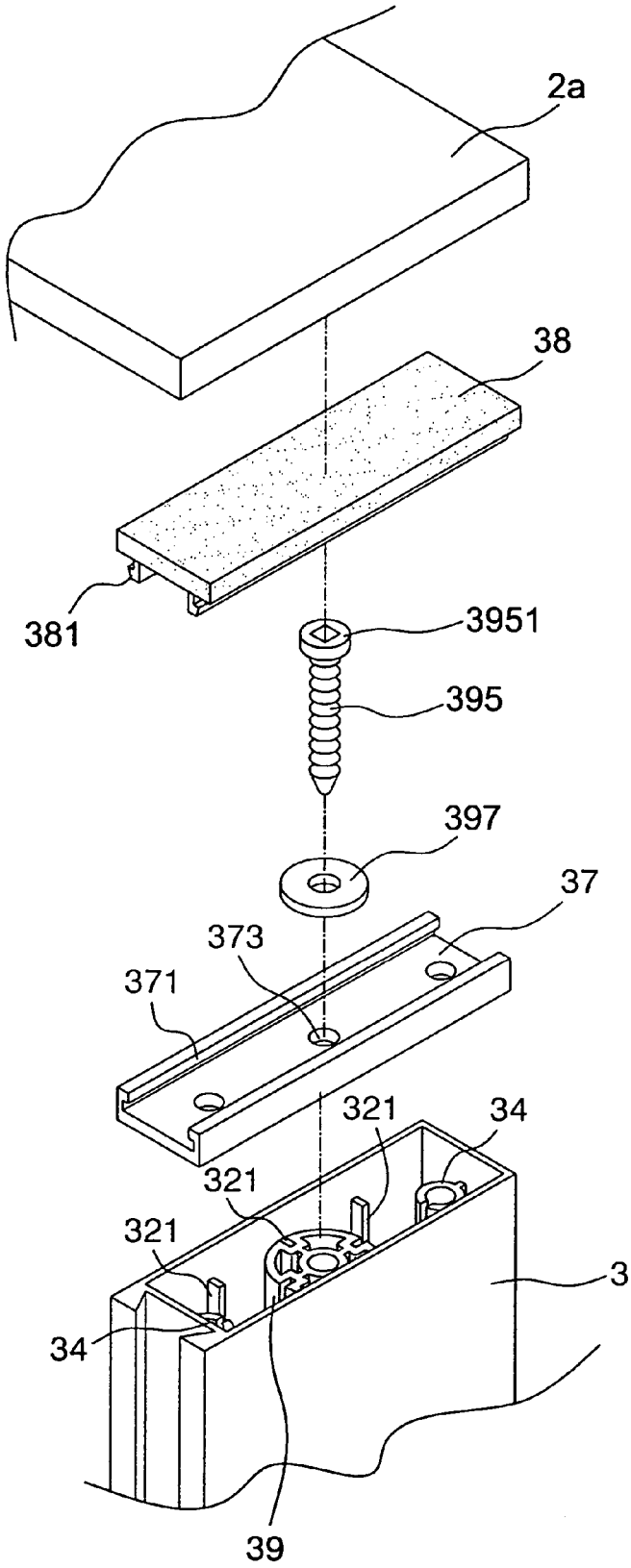
FIG. 18A and FIG. 18B are cross-sectional views showing a fastened mat and a fastened seat adding on a joint face between the erect rack board and the lateral rack board.
Figure 18B:
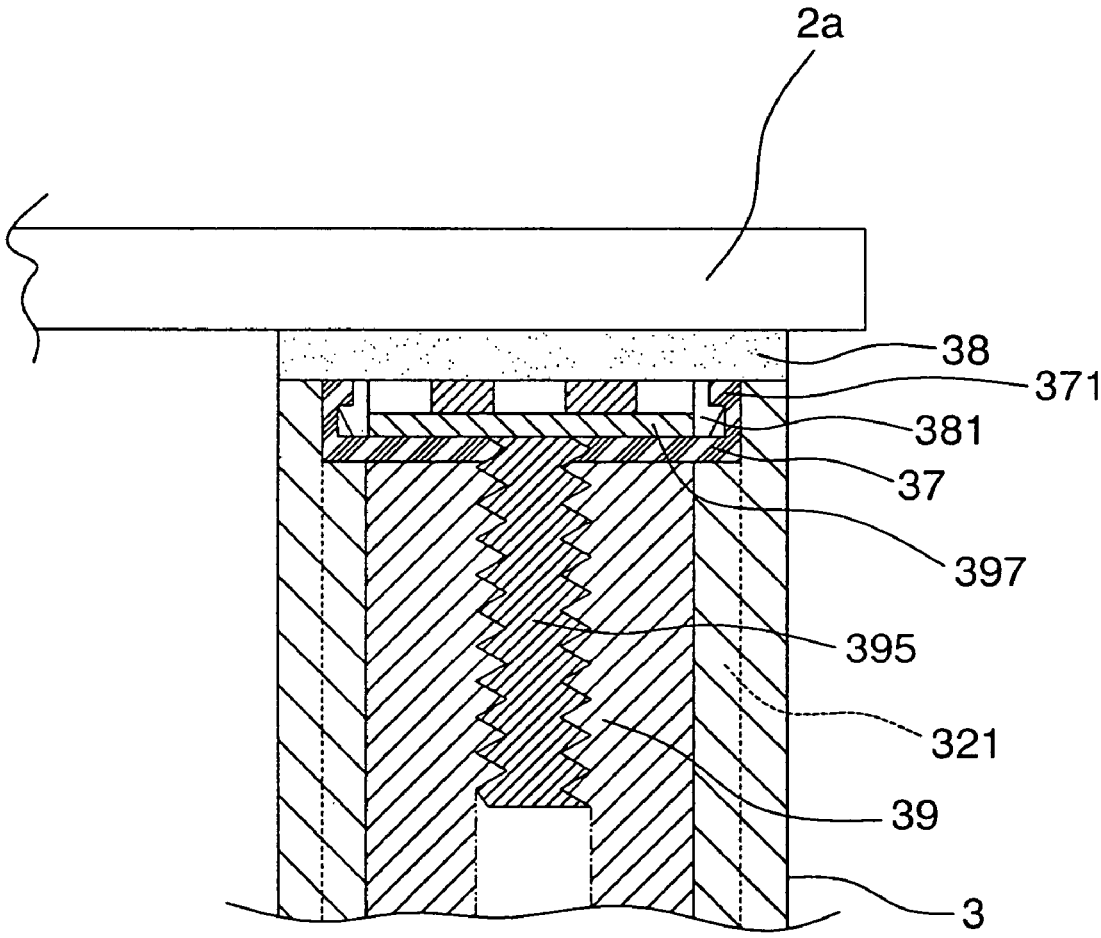

As shown in FIG. 18A and FIG. 18B, if the lateral rack board 2*a* on the top face is made of transparent material such as glass and the first through hole is not set to maintain the integrality, the first fixed portion 321 on a top face of the erect rack board 3 and the jack 34 may be shortened by a milling cutter, and the serial joint material 39 may also be shortened for a fastened seat having a groove 371 and an opening 373 to stride over and to be fixed by the bonding component 395 and the gasket 397. Additionally, a fastened mat 38 having a barb 381 is firstly pasted on a bottom face of the lateral rack board 2*a* by glue, thereby the erect rack board 3 can be bonded to the bottom face of the lateral rack board 2*a* by the barb 381 of the fastened mat 38 fastening to the groove 371 of the fastened seat 37.

However, the first fixed portion and the second fixed portion are not limited to the dovetail slot and the dovetail block mentioned in the above embodiment. It should be understood to those in the art that any slot and block having the same locking function can be used in the present invention.

Figure 19A:
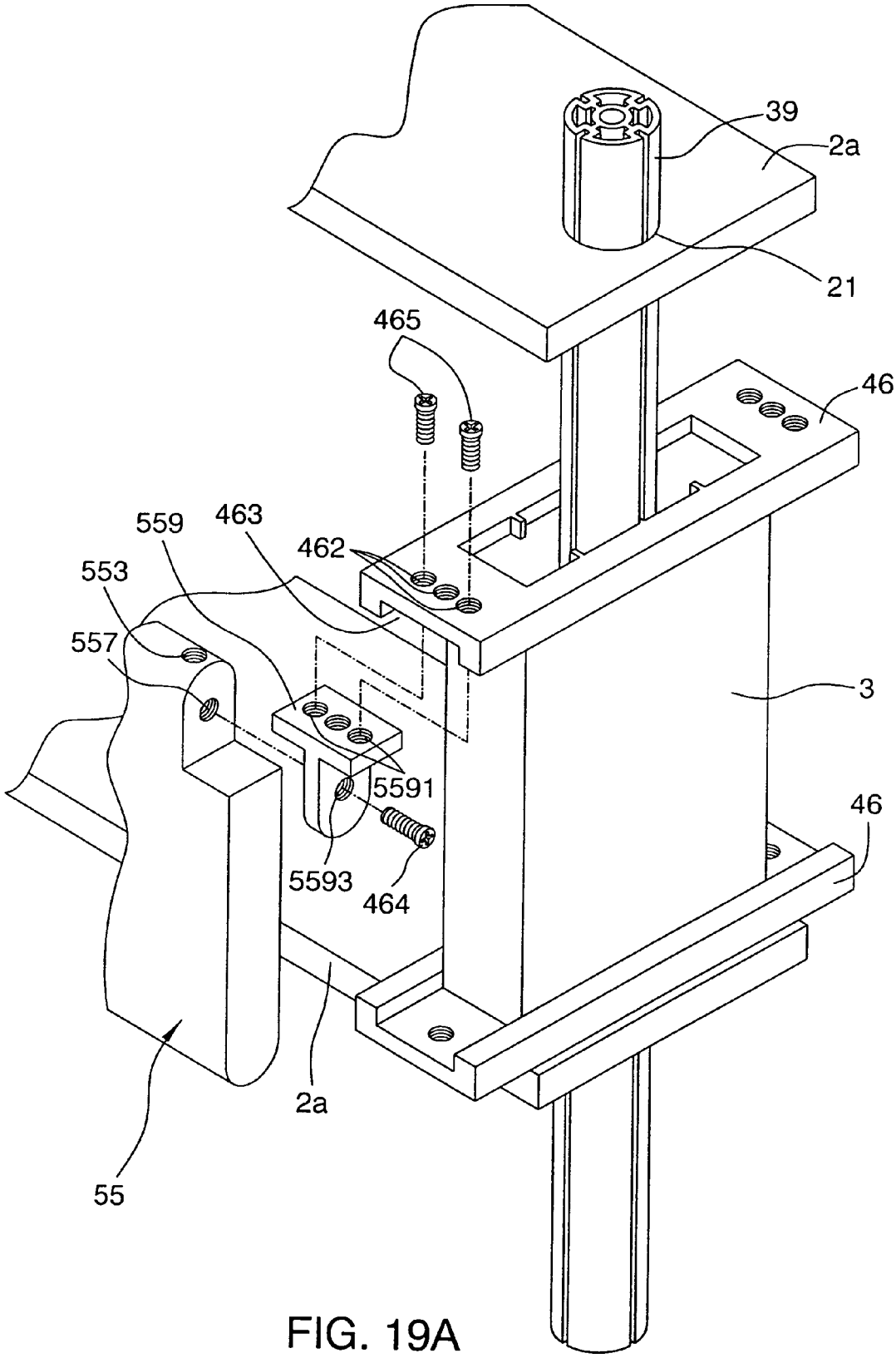
FIG. 19A and FIG. 19B are cross-sectional views showing an active door with upward opening formed by the intensified rack board of the lateral rack board and the erect rack board.
Figure 19B:
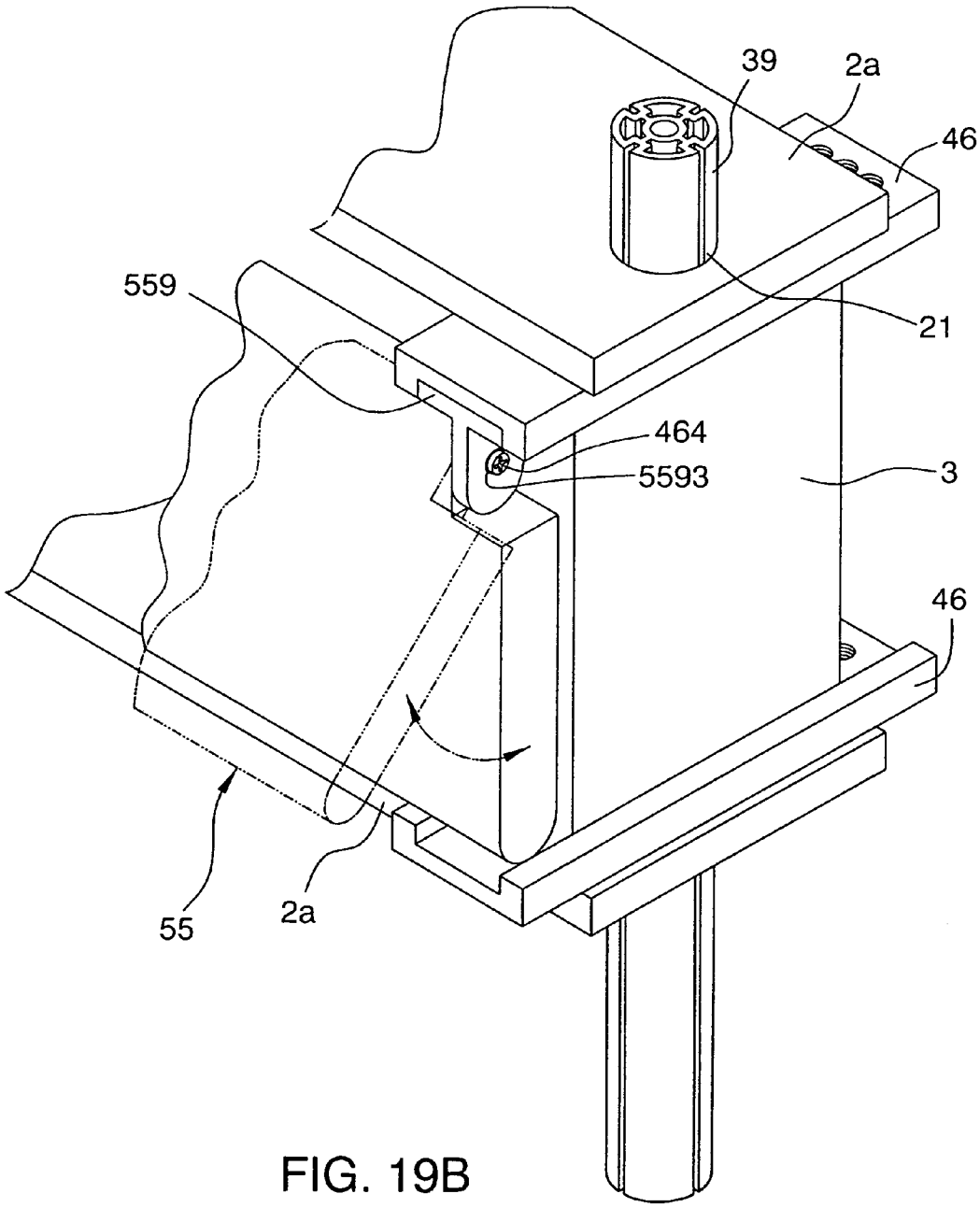

To increase the utility of the combined rack, the intensified rack board 55 can also form to an active door with upward opening or downward opening. As shown in FIG. 19A and FIG. 19B, a hinge joint component 559 can be assembled to each of the two adjacent expansion materials 46 which are at the same side of a frame unit and have the same height. The hinge joint component 559 has a T-shaped section, wherein second bonding portions 5591 are set on a top of the hinge joint component for screwing to the first bonding portions 462 by the bolts 465, and a lateral locking hole 5593 is set on a bottom of the hinge joint component for screwing the bolts. In the present embodiment, frames can be bonded around the intensified rack board 55, except for a jack 557 formed near the upside or downside of the outside of the frame, three first bonding portions 462 are spatially arranged on the expansion material. Thus, two hinge joint components can be set to the recess 463 of the expansion material 46 and fixed by screwing, furthermore the hinge joint components 559 are screwed to the locking hole by the bolts 464 and located to the jack 557, therefore the intensified rack board 55 can form to an active door with upward opening.

As described in the above combined components assembly of a combined rack of the present invention, the expansion material is used to stride over the erect rack board and correspond to the lateral rack board for connecting to other frame units or bonding to the intensified rack board, such that elastic expansion and variation functions of the combined rack can be provided. Additionally, structural strength of the combined rack can be enhanced by the serial fixation of the serial joint material and the bond of the intensified rack board. Therefore, by use of the design in the present invention, the combined rack can be enlarged, and the assembly formation of the combined rack and the amount of the frame unit can be changed freely in accordance with the elastic expansion of the combined rack. Meanwhile, the bonding components are not needed to provide functions of bearing the total weight of the combined rack and bending torque which may cause distortion. Accordingly, the bonding intensity of the combined rack is perfect and there may be no looseness between the bonding components and the bonding portions of the serial joint material.

If width expansion is needed, the combined components with the same height can be selected and the original lateral rack board, erect rack board, serial joint material, expansion material and intensified rack board can be reused, so the combined rack has integration in appearance and can accord with environmental protection. Furthermore, the left and right erect rack boards and the upper and lower lateral rack boards are fixed tightly by the intensified rack boards, thereby the structural intensity of the combined rack is increased and the combined rack can be applied in various loads. Therefore, the combined rack of the present invention can solve problems of the prior art, such as difficulty in expansion, low structural intensity, limitation in load and combination, unreusability of combined components, appearance without integration and the like.

As a result, the combined components assembly of a combined rack of the present invention can solve problems of the prior art, thereby it improves various essential effects and has more values in product use.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

I claim:

1. A combined components assembly of a combined rack, at least comprising:

a lateral rack board having a first through hole;

an erect rack board for forming a frame unit with the lateral rack board, wherein the erect rack board has a second through hole;

an expansion material for striding over the erect rack board and corresponding to the lateral rack board, wherein the expansion material has at least a third through hole and two first bonding portions for striding to two sides of the erect rack board;

an intensified rack board setting between a plurality of expansion material of a frame unit, wherein the intensified rack board has two second bonding portions for respectively bonding to the first bonding portions; and a serial joint material for penetrating through the first through hole, the second through hole and the third through hole in order to serially fix the lateral rack board, the erect rack board and the expansion material.

2. The combined components assembly of a combined rack of claim 1, wherein the expansion material has two first bonding portions, and a plurality of third through holes spatially arranged between the two first bonding portions.

3. The combined components assembly of a combined rack of claim 1, wherein the first bonding portion is a big screw and the second bonding portion is a small screw for a bolt passing through the big screw and bonding to the small screw.

4. The combined components assembly of a combined rack of claim 1, wherein the first bonding portion is a big screw and the second bonding portion is a small screw for bonding a bolt which has a rotation axis on a bottom of the bolt to the big screw and axially connecting to the small screw by the rotation axis.

5. The combined components assembly of a combined rack of claim 1, wherein a bottom side of the expansion material has a groove for striding over the erect rack board.

6. The combined components assembly of a combined rack of claim 1, wherein the intensified rack board can be rotatively bonded to the first bonding portion by the second bonding portion of the same side.

7. The combined components assembly of a combined rack of claim 1, wherein each of two sides of the intensified rack board is bonded to a frame and the first bonding portions are formed on a upper and a lower end of the frame.

8. The combined components assembly of a combined rack of claim 1, wherein the third bonding portion is set on two sides of the serial joint material respectively for connecting a bonding component.

9. The combined components assembly of a combined rack of claim 8, wherein a bottom segment of the serial joint material has an outer thread for screwing a foot rest having an inner thread.

10. The combined components assembly of a combined rack of claim 1, further comprising a hinge joint component for bonding to the expansion material, wherein the hinge joint component includes a lateral locking hole for lateral assembling the intensified rack board to form an active door with upward opening or downward opening.

11. The combined components assembly of a combined rack of claim 1, wherein a first fixed portion is set on at least one side of the erect rack board corresponding to the second through hole, and a second fixed portion opposed to the first fixed portion is set on an outside of the serial joint material.

12. The combined components assembly of a combined rack of claim 1, wherein the erect rack board further includes a jack for plugging a non-slip mat.

13. The combined components assembly of a combined rack of claim 1, further comprising a spacer for setting on a joint face between the erect rack board and the lateral rack board.

14. The combined components assembly of a combined rack of claim 1, further comprising a fastened seat for bonding to a top face of the erect rack board and a fastened mat for bonding to a bottom face of the lateral rack board, wherein the fastened seat has a groove and the fastened mat has a barb for fastening to each other.

15. The combined components assembly of a combined rack of claim 1, further comprising a clap board rack having at least a raised line on an outside thereof, a stridden slot for striding over a top or a bottom end of the erect rack board, and two raised lines symmetrical to the clap board rack for striding over the clap board rack.

16. The combined components assembly of a combined rack of claim 1, wherein the lateral rack board has at least a recess which is opened towards a bottom for holding a lamp, and a slot is set at a bottom edge of the recess for plugging a transparent window board.

17. The combined components assembly of a combined rack of claim 16, wherein a side of the lateral rack has a slot for further combining with a lateral expansion member having an insertion bar and a slot respectively formed at two sides.

18. The combined components assembly of a combined rack of claim 17, wherein the lateral expansion member may be made of transparent material and the inner surfaces thereof may be reflective surfaces for reflecting the light toward the top and the bottom of the lateral rack board.

19. The combined components assembly of a combined rack of claim 1, wherein an outer frame board having a fourth through hole for penetrating the serial joint material is bonded to an outside of the lateral rack board, and two side closing boards are respectively bonded to two sides of the outer frame board.

20. The combined components assembly of a combined rack of claim 1, wherein a first locked portion is set on at least one side of the erect rack board or the lateral rack board.

21. The combined components assembly of a combined rack of claim 20, further comprising a butt joint material with two second locked portions respectively on two sides of the butt joint material for locking to the first locked portion.

22. The combined components assembly of a combined rack of claim 20, further comprising a back rack board having two spaced second locked portions for locking to the first locked portions of the two erect rack boards.

23. The combined components assembly of a combined rack of claim 20, further comprising a ribbon having a second locked portion for locking to the first locked portion.

24. The combined components assembly of a combined rack of claim 20, further comprising a hook material having a second locked portion for locking to the first locked portion.

* * * * *